US009811043B2

(12) United States Patent
Mimbu et al.

(10) Patent No.: US 9,811,043 B2
(45) Date of Patent: Nov. 7, 2017

(54) IMAGE FORMING APPARATUS

(71) Applicants: Ryuuichi Mimbu, Kanagawa (JP); Yoshio Hattori, Kanagawa (JP); Haruyuki Honda, Kanagawa (JP); Toshihiko Shimokawa, Kanagawa (JP); Yoshiki Yamaguchi, Kanagawa (JP)

(72) Inventors: Ryuuichi Mimbu, Kanagawa (JP); Yoshio Hattori, Kanagawa (JP); Haruyuki Honda, Kanagawa (JP); Toshihiko Shimokawa, Kanagawa (JP); Yoshiki Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/064,076

(22) Filed: Mar. 8, 2016

(65) Prior Publication Data

US 2016/0274523 A1 Sep. 22, 2016

(30) Foreign Application Priority Data

Mar. 17, 2015 (JP) ..... 2015-054004
Mar. 19, 2015 (JP) ..... 2015-056374

(51) Int. Cl.
*G03G 15/00* (2006.01)

(52) U.S. Cl.
CPC ..... *G03G 15/6558* (2013.01); *G03G 15/6576* (2013.01); *G03G 2215/00662* (2013.01); *G03G 2215/0132* (2013.01); *G03G 2215/2035* (2013.01)

(58) Field of Classification Search
CPC ..... G03G 15/6576
USPC ..... 399/406
See application file for complete search history.

(56) References Cited

U.S. PATENT DOCUMENTS 5,680,651 A * 10/1997 Tsuji ..... G03G 15/234 271/186
6,032,949 A * 3/2000 Ando ..... B65H 9/166 271/186
9,073,724 B2 * 7/2015 Uehara ..... B65H 29/70
9,229,410 B2 * 1/2016 Furushige ..... G03G 15/6576
2003/0190180 A1 * 10/2003 Katayanagi ..... G03G 15/2064 399/406

(Continued)

FOREIGN PATENT DOCUMENTS

JP 62-231963 10/1987
JP 8-137309 5/1996

(Continued)

*Primary Examiner* — Anthony Nguyen
(74) *Attorney, Agent, or Firm* — Harness, Dickey, & Pierce P.L.C.

(57) ABSTRACT

An image forming apparatus includes an image forming device to transfer an image to a recording sheet; a fixing device to feed the recording sheet and fix the image onto the recording sheet; a branching device to switch between an ejection path to eject the recording sheet fed downstream of the fixing device, to outside the apparatus, and a reversing path for duplex printing; and a back curl correction structure disposed in a sheet feeding path between the fixing device and the branching device. The back curl correction structure includes a drive roller; a driven roller; an auxiliary nip portion; a guide member; and a guide moving device to move the guide member to a first position and a second position depending on the condition of the recording sheet.

15 Claims, 13 Drawing Sheets

(56) References Cited

U.S. PATENT DOCUMENTS

| | | | | |
|---|---|---|---|---|
| 2006/0056895 | A1* | 3/2006 | Mizuno | G03G 15/6576 399/406 |
| 2008/0038031 | A1* | 2/2008 | Koshida | G03G 15/6576 399/406 |
| 2010/0329718 | A1* | 12/2010 | Isohara | G03G 15/20 399/68 |
| 2015/0030366 | A1* | 1/2015 | Honda | G03G 15/6576 399/406 |

FOREIGN PATENT DOCUMENTS

| | | |
|---|---|---|
| JP | 9-188456 | 7/1997 |
| JP | 10-123781 | 5/1998 |
| JP | 2001-048399 | 2/2001 |
| JP | 2008-122520 | 5/2008 |
| JP | 2009-126638 | 6/2009 |
| JP | 2011-006248 | 1/2011 |
| JP | 2011-149982 | 8/2011 |
| JP | 2012-091891 | 5/2012 |

* cited by examiner

IMAGE FORMING APPARATUS

CROSS-REFERENCE TO RELATED APPLICATIONS

The present application claims priority pursuant to 35 U.S.C. §119(a) from Japanese patent application numbers 2015-054004, and 2015-056374 filed on Mar. 17, 2015 and Mar. 19, 2015, respectively, the entire disclosure of each of which is incorporated by reference herein.

BACKGROUND

Technical Field

The present invention relates to an electrophotographic image forming apparatus, such as a copier, a printer, or a facsimile machine.

Description of the Related Art

In an electrophotographic image forming apparatus, an electrostatic latent image is first formed in an image forming section, the electrostatic latent image is developed by toner as a developer and is rendered visible as a toner image, the developed toner image is transferred to a recording sheet by a transfer device, and subsequently, the image is fixed onto the recording sheet as a final image by a fixing device.

The fixing device includes a heating member and a pressure roller that press against each other to form a fixing nip, through which the recording sheet on which an unfixed toner image is borne passes. The recording sheet is pressed and heated when passing through the fixing nip (i.e., between the heating member and the pressure roller), so that the toner image is fixed onto the recording sheet.

In this type of heat fixation, there is a difference in temperature between the heating member and the pressure roller, and therefore between the front and back side back side of the recording sheet. Specifically, the surface of the recording sheet contacting the heating member shows a higher temperature than the back side of the recording sheet contacting the pressure roller.

As a result, after passing through the fixing nip, moisture contained in the recording sheet evaporates more from the front surface of the recording sheet than from the back side, and the moisture moves from the back side to the front side. As a result, moisture inside the front side becomes greater than that in the back side and extension of fibers in the front side becomes greater, so that the recording sheet curls to the back side (called a back curl).

Recently, in particular, the heating member is formed to have a lower thermal capacity for a quick rise in the temperature to save energy and shorten warm-up time. With such a fixing device, because feeding sheet becomes ready before the heating member is satisfactorily warmed, a difference in the temperature between the heating member and the pressure roller increases and the difference in the temperature between the front and back side of the recording sheet in the fixing process tends to be greater. Thus, a back curl occurring in the fixing nip becomes pronounced. In such a fixing device, when the recording sheet is ejected with a large back curl, the rated number of recording sheets cannot be stacked on a sheet tray, or alternatively, the stacked sheets in the tray are messed up.

SUMMARY

In one embodiment of the disclosure, provided is an optimal image forming apparatus including an image forming device to transfer an image to a recording sheet; a fixing device to feed the recording sheet to a fixing nip portion and fix the image onto the recording sheet; a branching device to switch between an ejection path to eject the recording sheet fed downstream of the fixing device, to outside the apparatus, and a reversing path for duplex printing; and a back curl correction structure disposed in a sheet feeding path between the fixing device and the branching device. The back curl correction structure includes a drive roller disposed at a side where a back curl is generated on the recording sheet in the fixing nip portion; a driven roller disposed at a side where the recording sheet is heated; an auxiliary nip portion between the drive roller and the driven roller, to press and feed the recording sheet auxiliary; a guide member, disposed at the same side as the drive roller relative to the sheet feeding path, to guide the recording sheet; and a guide moving device to move the guide member to a first position to press the recording sheet while the recording sheet is passing through the auxiliary nip portion and a second position separated from the recording sheet.

These and other objects, features, and advantages of the present invention will become apparent upon consideration of the following description of the preferred embodiments of the present invention when taken in conjunction with the accompanying drawings.

DETAILED DESCRIPTION

Figure 1:
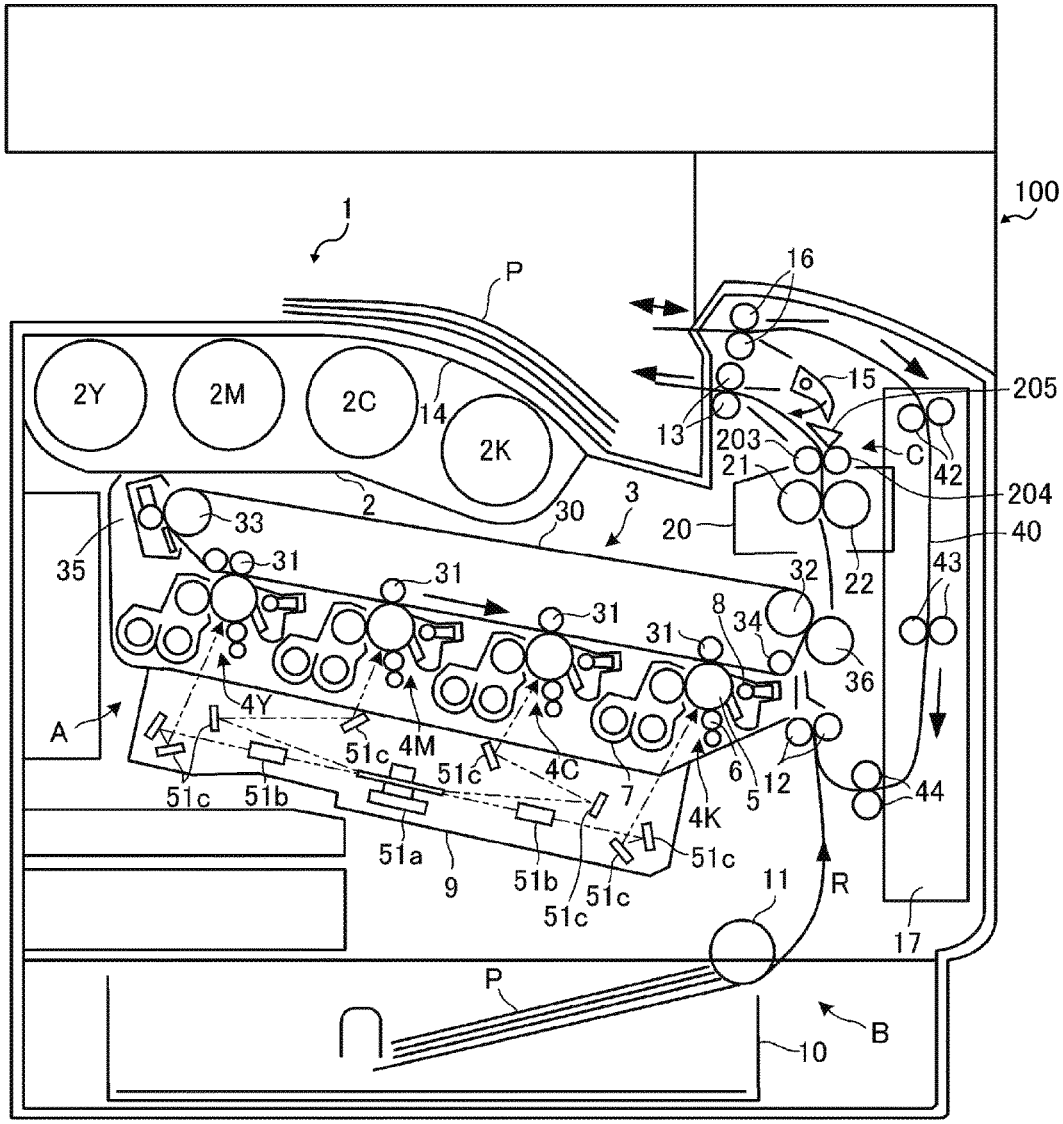
FIG. 1 is a general configuration of an image forming apparatus according to an embodiment of the present invention.

A typical image forming apparatus includes a guide member disposed along a sheet feeding path between a first feed roller and a second feed roller which are disposed at different positions downstream of a fixing section. The guide member guides the recording sheet while bending it to a direction opposite that of the back curl occurring to the recording sheet when the recording sheet passes through the fixing nip. In the above example, the second feed roller is set to have a feed speed to feed the recording sheet faster than that of the first feed roller, and the recording sheet is fed being pressed by the guide member that is bent in a direction opposite that of the back curl of the recording sheet, so that the curl of the recording sheet is corrected.

Another transfer sheet curl correction device of the image forming apparatus includes, as a correction device for the back curl, a pair of rollers disposed along the sheet feeding path downstream of the fixing device and a guide member to guide member the recording sheet while bending it to a direction opposite that of the back curl thereof passing through the pair of roller. The image forming apparatus corrects the curl of the recording sheet by bending it to a direction opposite that of the back curl that has occurred to the recording sheet while passing through the fixing nip.

In further another example, an ejection device includes a guide member between the fixing nip and an ejection nip disposed downstream of the fixing nip. The guide member movably disposed contacts a back side of the recording sheet, bends the back curl in a direction opposite that of the back curl, and changes the contacting power depending on rigidity of each sheet.

Each of the above back curl correction methods includes following drawbacks.

The recording sheet is constantly and forcibly pressed by the guide member to curl back in the opposite direction. For example, when the sheet is a thick sheet, no back curl occurs even though pressed in the fixing device. As a result, when the guide member is disposed at a first position constantly, the thick sheet may include a face curl. In addition, because the contacting power between the guide member and the recording sheet is strong, the recording sheet suffers a damage such as scratches and abrasion from the guide member. Further, due to a high rigidity of the sheet, a leading end of the sheet that contacts the guide member upon going out from the pair of roller bends, and the stability in sheet feeding is degraded.

Further, the guide member that forcibly deforms the recording sheet is formed to be movable to a retracting direction due to a rigidity of the recording sheet. As a result, even though the guide member retracts, the recording sheet is conveyed while contacting the guide member. Thus, when the duplex printing is performed, the back side of the recording sheet contacting the guide member includes an image on the first side. In this case, the image surface and the guide member contact, thereby damaging the toner image.

Even though the guide member is moved to a final retracted position, because the position of the guide member is determined by the rigidity of the recording sheet, there is no difference in the fact that the recording sheet is conveyed while contacting the guide member. Thus, when the duplex printing is performed, the back side of the recording sheet contacting the guide member includes an image on the first side and the image surface and the guide member contact. Immediately after fixing the second surface, even though the back side image is not affected from the heat completely fusing the toner, the toner image affected by the heat contacts the guide member. In this case, even with a slight contact, uneven gloss tends to occur as a difference in the gloss between a part contacting the guide member and another part not contacting the guide member. The rigidity of the recording sheet is not enough to control the contact pressure between the guide member and the recording sheet, and the uneven gloss cannot be prevented completely. In addition, there is a restriction on the relative positions of the fixing nip or exit nip and the guide member, resulting in reduced design flexibility.

The present invention aims to provide an image forming apparatus capable of solving the aforementioned problems, reducing a back curl due to fixation, stabilizing sheet conveyance, and reducing damage to the recording sheet and toner image.

First, a general configuration of an image forming apparatus 1 according to an embodiment of the present invention will be described.

As illustrated in FIG. 1, the image forming apparatus 1 according to the present embodiment, is a color laser printer, and includes an image forming section A as an image forming device, a sheet feed section B, a fixing device 20, a pair of ejection rollers 13, a sheet tray 14, a pair of reverse rollers 16, and a duplex unit 17.

The image forming section A includes four image forming units 4Y, 4M, 4C, and 4K, an exposure unit 9, and a transfer device 3. The fixing device 20 of the present image forming apparatus 1 includes a back curl correction structure C, to be described in detail later.

As illustrated in FIG. 1, the image forming apparatus 1 includes four image forming units 4Y, 4M, 4C, and 4K disposed in the center of the apparatus. Each of the image forming units 4Y, 4M, 4C, and 4K has the same structure except that each includes a different color of toner such as yellow (Y), magenta (M), cyan (C), and black (K) that corresponds to RGB color separation component of a color image.

Specifically, each image forming unit 4Y, 4M, 4C, and 4K includes a drum-shaped photoconductor 5 as a latent image bearer; a charger 6 to charge a surface of the photoconductor 5; a developing device 7 to supply toner on the surface of the photoconductor 5; and a cleaning unit 8 to clean the surface of the photoconductor 5. In FIG. 1, each of the photoconductor 5, the charger 6, the developing device 7, and the cleaning unit 8 included in the black image forming unit 4K is supplied with a reference numeral and reference numerals for other image forming units 4Y, 4M, and 4C configured similarly to the image forming unit 4K are omitted.

The exposure unit 9 to expose the surface of the photoconductor 5 is disposed underneath the image forming units 4Y, 4M, 4C, and 4K. The exposure unit 9 includes a laser light source, a polygonal mirror 51*a*, an fθ lens 51*b*, a plurality of reflection mirrors 51*c*, and the like, and is configured to irradiate each surface of the photoconductor 5 with laser beams based on image data, to thereby form an electrostatic latent image on the surface of the photoconductor 5.

A transfer device 3 is disposed above each of the image forming units 4Y, 4M, 4C, and 4K. The transfer device 3 includes an intermediate transfer belt 30 as an intermediate transfer member; four primary transfer rollers 31 as primary transfer members; a secondary transfer backup roller 32; a cleaning backup roller 33; a tension roller 34; and a belt cleaning device 35.

The intermediate transfer belt 30 is an endless belt stretched around the secondary transfer backup roller 32, the cleaning backup roller 33, and the tension roller 34. When the secondary transfer backup roller 32 rotates, the intermediate transfer belt 30 is driven to rotate in the direction indicated by an arrow in the figure.

The four primary transfer rollers 31 each are disposed opposite each photoconductor 5 with the intermediate transfer belt 30 sandwiched in between, thereby forming a primary transfer nip. In addition, each primary transfer roller 31 is connected to a power source and a predetermined direct current (DC) voltage or alternating current (AC) voltage is applied to each primary transfer roller 31.

The secondary transfer roller 36 sandwiches the intermediate transfer belt 30 together with the secondary transfer backup roller 32 so as to form a secondary transfer nip. In addition, similarly to the primary transfer rollers 31, the secondary transfer roller 36 is connected to a power source, and a predetermined direct current (DC) voltage or alternating current (AC) voltage is applied to the secondary transfer roller 36.

The belt cleaning device 35 includes a cleaning brush and a cleaning blade, which are so disposed as to contact the intermediate transfer belt 30. Waste toner collected by the belt cleaning device 35 is conveyed via a waste toner conveying hose, and is contained in a waste toner container.

A bottle holder 2 is disposed in an upper part of the image forming apparatus. Four toner bottles 2Y, 2M, 2C, and 2K each containing toner for replenishment are detachably mounted to the bottle holder 2. A supply path is disposed between each toner bottle 2Y, 2M, 2C, or 2K and each developing device 7. Toner is supplied to each developing device 7 from a corresponding toner bottle 2Y, 2M, 2C, or 2K to each developing device 7.

The sheet feed section B is disposed in the bottom of the image forming apparatus. The sheet feed section B includes a sheet tray 10 in which a recording sheet P as a recording medium is contained, and a sheet feed roller 11 to feed the recording sheet P from the sheet tray 10.

In addition to a regular sheet, the recording medium may include various media such as cardboard, postcards, envelopes, thin paper, coated paper or art paper, tracing paper, an OHP sheet, and the like. A manual sheet feeder may be disposed in the image forming apparatus. In the present embodiment, the term "cardboard" means paper having a basis weight of 160 grams/$m^2$ or more.

Further, a sheet feeding path R through which the recording sheet P is conveyed from the sheet tray 10 to an outside the apparatus via the secondary transfer nip is disposed inside a body 100 of the image forming apparatus 1. A pair of registration rollers 12 serving as a timing roller to convey the sheet P to the secondary transfer nip at an appropriate timing for conveyance is disposed upstream in the sheet conveyance direction of the secondary transfer roller 36 in the sheet feeding path R.

The fixing device 20 presses and heats the recording sheet P on which an unfixed image is borne and thereby fixes the toner image onto the recording sheet P. The fixing device 20 is disposed downstream in the sheet conveyance direction than the position of the secondary transfer roller 36. Further, a pair of sheet ejection rollers 13 to eject the sheet outside the body of the apparatus is disposed downstream of the fixing device 20 in the sheet conveyance direction of the sheet feeding path R. In addition, a sheet ejection tray 14 to stock the sheet ejected outside the apparatus is disposed on an upper surface of the body of the apparatus.

Further, a branching member 15 is disposed between the sheet ejection rollers 13 and the fixing device 20. The branching member 15 is rotatably fixed to the body, coming to be at a first state as illustrated in FIG. 1 in single-side printing mode, and turning out to be at a second state closing in a direction indicated by an arrow from the first state in a duplex printing mode.

Specifically, the branching member 15 formulates a sheet feeding path branching device of the present invention, because the branching member 15 serves to switch an outside ejection path (that is, a path passing the sheet ejection rollers 13) to eject the recording sheet P conveyed downstream of the fixing device 20 to the sheet ejection tray 14 disposed outside the apparatus, to a reversing path, a path inside the duplex unit 17 (to be described later) of the duplex printing. Further, a back curl correction structure C, which will be described later, is disposed between the branching member 15 and the fixing device 20.

A duplex reversing path 40 includes a reverse roller 16 to switch back the recording sheet P disposed downstream of the branching member 15, and a duplex unit 17 disposed between the reverse roller 16 and the registration rollers 12. The duplex unit 17 formulates a reversing path of the duplex printing, including feed rollers 42 to 44, allows the reverse roller 16 to switch back the recording sheet P, a first side of which has been fixed, and feeds the recording sheet P to the registration rollers 12 via the feed rollers 42 to 44.

Next, a basic operation of the image forming apparatus 1 according to an embodiment of the present invention will be described.

When an image forming operation is started, each photoconductor 5 of each of the image forming units 4Y, 4M, 4C, and 4K is driven to rotate clockwise as illustrated in FIG. 1, and each surface of the photoconductor 5 is uniformly charged at a predetermined polarity by the charger 6. The exposure unit 9 irradiates laser beams to the charged surface of each photoconductor 5 and an electrostatic latent image is formed on the surface of each photoconductor 5.

In this case, the image data exposed on each photoconductor 5 is monochrome image data, decomposed from the target full-color image into color data of yellow, magenta, cyan, and black. Each developing device 7 supplies toner to the electrostatic latent image formed on the photoconductor 5, and the electrostatic latent image is rendered a visible image.

When the image forming operation is started, the secondary transfer backup roller 32 rotates in the counterclockwise direction and the intermediate transfer belt 30 is driven to rotate in the direction indicated by an arrow in the figure.

In addition, because the constant voltage or the constant-current controlled voltage with a polarity opposite that of the toner is applied to each of the primary transfer rollers 31, a transfer electric field is formed in the primary transfer nip between each of the primary transfer rollers 31 and each photoconductor 5.

Thereafter, upon the toner image of each color formed on the photoconductor 5 reaching the primary transfer nip along with the rotation of each photoconductor 5, the toner image of each color formed on each photoconductor 5 is sequentially transferred in a superposed manner on the intermediate transfer belt 30 by the transfer electric field formed in the primary transfer nip.

Thus, a full-color toner image is borne on the surface of the intermediate transfer belt 30. In addition, the residual toner which has not been transferred to the intermediate transfer belt 30 and is remaining on each photoconductor 5 is removed by the cleaning unit 8.

Thereafter, the surface of each photoconductor 5 is electrically discharged by a discharger and the surface potential is initialized.

The sheet feed roller 11 disposed in the bottom of the body 100 is started to rotate so that the sheet P is fed out from the sheet tray 10 to the sheet feeding path R. The recording sheet P fed out to the sheet feeding path R is once stopped by the registration rollers 12.

Then, the registration rollers 12 starts to rotate at a predetermined timing and feeds the recording sheet P to the secondary transfer nip at the same time as the image on the intermediate transfer belt 30 arrives at the secondary transfer nip. In this case, because the transfer voltage having a polarity opposite that of the charged toner of the toner image on the intermediate transfer belt 30 is applied to the secondary transfer roller 36, a transfer electric field is formed at the secondary transfer nip. Through the electric transfer field, the toner image on the intermediate transfer belt 30 is transferred en bloc to the recording sheet P. In addition, the residual toner that has not been transferred to the recording sheet P and is remaining on the intermediate transfer belt 30 is removed by a belt cleaning device 35 and is conveyed to and collected in the waste toner container.

Thereafter, the sheet P is conveyed to the fixing device 20, and the toner image on the sheet P is fixed by the fixing device 20 onto the recording sheet P. The branching member 15 switches a path to eject the recording sheet P to outside the apparatus and the duplex reversing path. The recording sheet P conveyed from the fixing device 20 passes through the branching member 15 and is guided to the ejection direction or re-feed direction.

In the single-side printing mode, the branching member 15 is open so that the recording sheet P is conveyed outside the apparatus by the pair of sheet ejection rollers 13, and is ejected onto the sheet ejection tray 14 to stock the recording sheet P, disposed on the upper face of the body of the image forming apparatus.

In the duplex printing mode, the branching member 15 closes in the direction indicated by the arrow, so that the recording sheet P after the first side has been fixed is guided to the duplex reversing path 40. The recording sheet P guided to the duplex reversing path 40 is switched back and is conveyed to the duplex unit 17, and is again conveyed and re-fed to the pair of registration rollers 12, and the image to be printed on the second side is printed on the back side thereof similarly to the first side. The recording sheet P is then ejected outside the apparatus by the sheet ejection rollers 13, and is stocked on the sheet ejection tray 14.

The explanation heretofore relates to an image forming operation when a full-color image is formed on the recording sheet P; however, a monochrome image may be formed using any one of the four image forming units 4Y, 4M, 4C, and 4K and an image formed of two or three colors may be possible by using two or three image forming units.

Next, the fixing device 20 including the back curl correction structure C of the image forming apparatus 1 will be described in detail.

Figure 2:
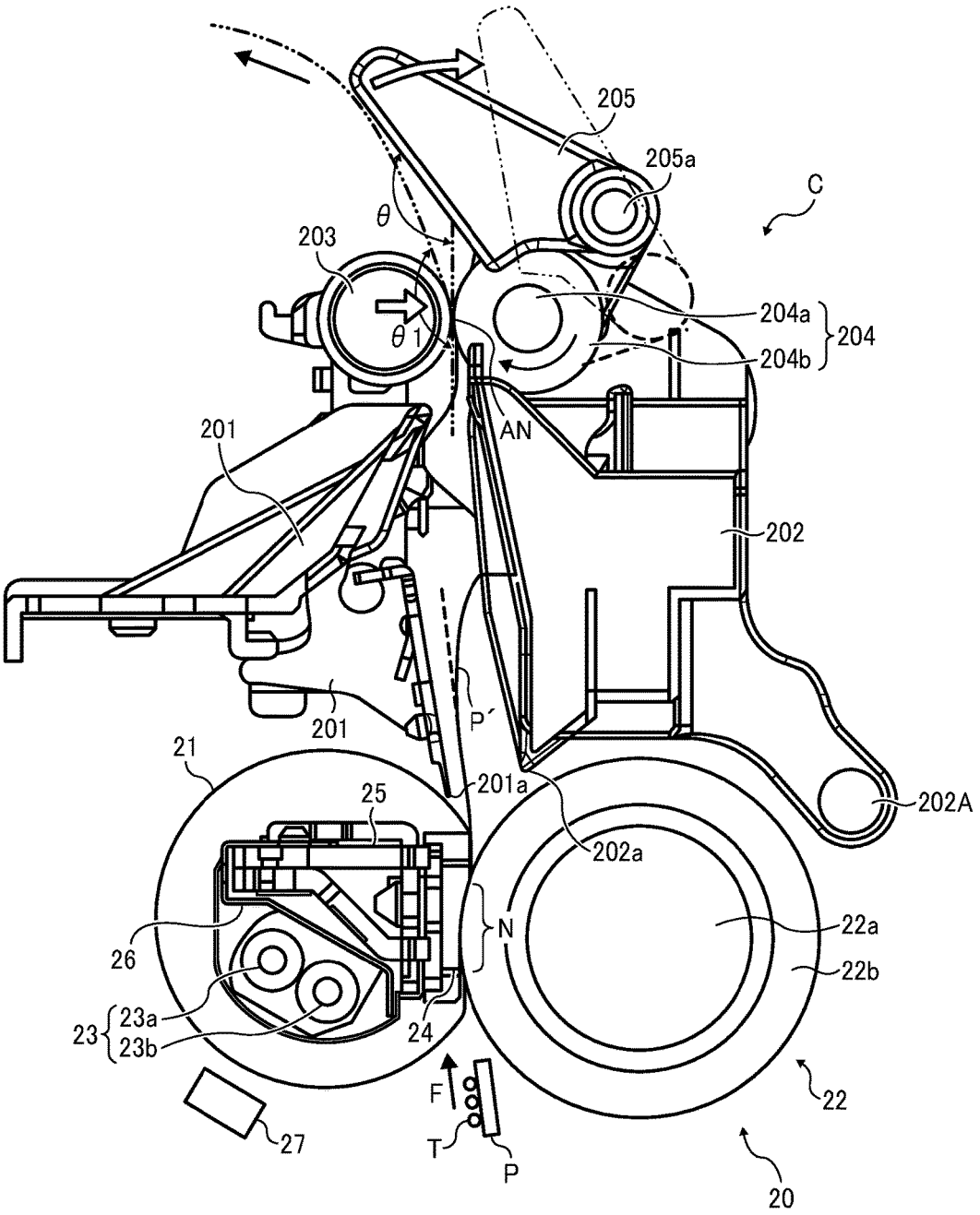
FIG. 2 illustrates a fixing device for correcting a back curl according to the embodiment of the present invention.

FIG. 2 is a cross-sectional view of the fixing device including a back curl correction structure according to the embodiment of the present invention.

As illustrated in FIG. 2, the fixing device 20 is used to fix/fuse the toner image T on the recording sheet P after the transfer process, with heat and pressure onto the recording sheet P. The fixing device 20 includes a flexible, endless fixing belt 21 that endlessly moves while being heated.

The fixing device 20 causes the recording sheet P on which the toner image is transferred in the image forming section A to pass through the fixing nip N (in a direction indicated by an arrow F) and causes to fix the toner image onto the recording sheet P with heat and pressure in the fixing nip N.

The fixing device 20 includes a pressure roller 22 in addition to the endless fixing belt 21 serving as a fixing member. The pressure roller 22, serving as a pressure member, is rotatably disposed opposite the fixing belt 21 and forms the fixing nip N applying pressure to the fixing belt 21 while contacting it. A heater or a heat source 23 including a plurality of halogen lamps 23*a* and 23*b* is disposed inside the fixing belt 21 and heats an interior side of the fixing belt 21.

Inside the fixing belt 21, disposed are a nip forming member 24, a base member disposed inside the fixing belt 21, a stay 25 to support the nip forming member 24, a reflecting member 26 to reflect light irradiated from the heater 23 to the fixing belt 21.

The nip forming member 24 serves as a base member for forming a nip and includes a friction sheet (a low-friction sheet) wound around the base pad.

The fixing nip portion N of the nip forming member 24 as illustrated in FIG. 2 has a planar shape, but the shape of the fixing nip portion N is not limited thereto. For example, if the fixing nip portion N is formed to have a concave shape along a peripheral surface of the pressure roller 22, a leading end of the recording sheet P which passes through the fixing nip portion N comes to a side of the pressure roller 22, thereby improving separability of the recording sheet P from the fixing belt 21.

The temperature of the fixing belt 21 is detected by a temperature sensor 27 disposed on a side where the recording sheet P enters the fixing nip portion, and is used for a feedback process of the heater 23. In FIG. 2, an arrow F shows a direction along which the recording sheet P is fed.

The fixing belt 21 is an endless belt formed in a thin, flexible, sleeve shape and is constructed of a base material and a release layer disposed on a surface of the base material. Examples of the base material include metallic materials such as nickel or A-SUS or resin materials such as polyimide. Examples of materials for the release layer having a releasability relative to the toner include copolymer of tetrafluoroethylene-perfluoroalkyl vinylether (PFA) or polytetrafluoroethylene (PTFE).

The pressure roller 22 includes a metal core 22*a*; an elastic layer 22*b* disposed on the peripheral surface of the metal core 22*a*, formed of the foamed silicon rubber, the silicon rubber, or the fluoro-rubber; and the release layer disposed on the surface of the elastic layer 22*b* and formed of PFA or PTFE.

The pressure roller 22 is pressed toward the fixing belt 21 by a biasing member, and contacts the nip forming member 24 as a base member via the fixing belt 21.

The elastic layer 22*b* of the pressure roller 22 is squeezed at a portion where the pressure roller 22 and the fixing belt 21 contact each other, so that the nip forming member 24 secures to have the fixing nip portion N with a predetermined width due to the pressure between the fixing belt 21 and the pressure roller 22.

The pressure roller 22 is configured to rotate by a driving source such as a motor disposed in the printer body. Further, when the pressure roller 22 is driven to rotate, the driving force of the pressure roller 22 is transmitted to the fixing belt 21 at the fixing nip portion N, so that the fixing belt 21 is driven to rotate.

In the fixing device 20 according to the present embodiment, the pressure roller 22 is configured as a solid-core roller, but may instead be a hollow roller. When the pressure roller 22 is a hollow roller, a heat source such as a halogen heater using radiation heat may be disposed inside the pressure roller 22. If the pressure roller 22 does not include an elastic layer, the thermal capacity of the pressure roller 22 is reduced and the fixing property is improved. However, when the unfixed toner is pressed and fixed, minute concavity and convexity of the belt surface is transferred to the image and the solid image portion may include uneven glossiness. To prevent such uneven glossiness of the image, the elastic layer with a thickness of 100 μm or more is desired.

Examples of materials for a pipe-shaped metal to be used for the hollow roller include iron or stainless steel. When a heat source is disposed inside the pressure roller 22, a heat insulation layer need be disposed on a surface of a substrate, or alternatively, a heat ray reflection surface need be provided by mirror finishing, to thereby prevent the substrate from heated from the radiation heat from the heat source. In addition to the above-described halogen heater, an IH heater, a resistance heat generator, or a carbon heater can be used for the heat source.

Because the above fixing device 20 employs a structure to directly heat the low-thermal capacity heating member, a temperature of the fixing device 20 increases very quickly and a first print can be obtained quickly. However, in terms of the back curl of the recording sheet P, because fixation is performed before the heat roller is fully heated, the difference in the temperature of the front side and the back side of the recording sheet P causes the back curl (that is, a curved shape of a solid line P' as illustrated in FIG. 2) to be generated greatly.

A separator/feeder device disposed at an outlet side of the recording sheet of the fixing device 20 separates the recording sheet P that has passed through the fixing nip portion N, in the vicinity of the fixing nip portion N and guides it to the ejection direction. The separator/feeder device includes a belt-side separator member 201 disposed on the side of the fixing belt 21 and a pressure-side separator member 202 disposed on the side of the pressure roller 22. The belt-side separator member 201 includes a tip end 201*a* that approaches the fixing belt 21 downstream in a moving direction of the recording sheet P moving from the fixing nip portion. The pressure-side separator member 202 includes an oscillation end 202*a* that approaches the pressure roller 22.

The belt-side separator member 201 is disposed to peel off the recording sheet P that tends to adhere to the fixing belt 21, from the fixing belt 21. Accordingly, the belt-side separator member 201 is preferably formed of metal material to have a precision in positioning so that the recording sheet P adhering to the fixing belt 21 can be peeled off from the surface of the fixing belt 21. Thus, to obtain a precision in positioning the adhering recording sheet P at a proximate position so that the recording sheet P can float from the surface of the fixing belt 21, the metal material is employed for the separator member 201.

The pressure-side separator member 202 is formed of a resin mold and includes a support rod 202A disposed on a part thereof. The support rod 202A is rotatably supported to a side of the apparatus body, and the pressure-side separator member 202 oscillates such that the oscillation end 202*a* disposed opposite the pressure roller 22 can be attached to and detached from the pressure roller 22.

The pressure-side separator member 202 oscillates relative to the pressure roller 22, and oscillates greatly in a direction separating from the pressure roller 22 when a jammed recording sheet P is removed from the fixing nip portion N, to secure a large space for maintenance to the fixing nip portion N. With this structure, the recording sheet P can be removed with ease.

Figure 6:
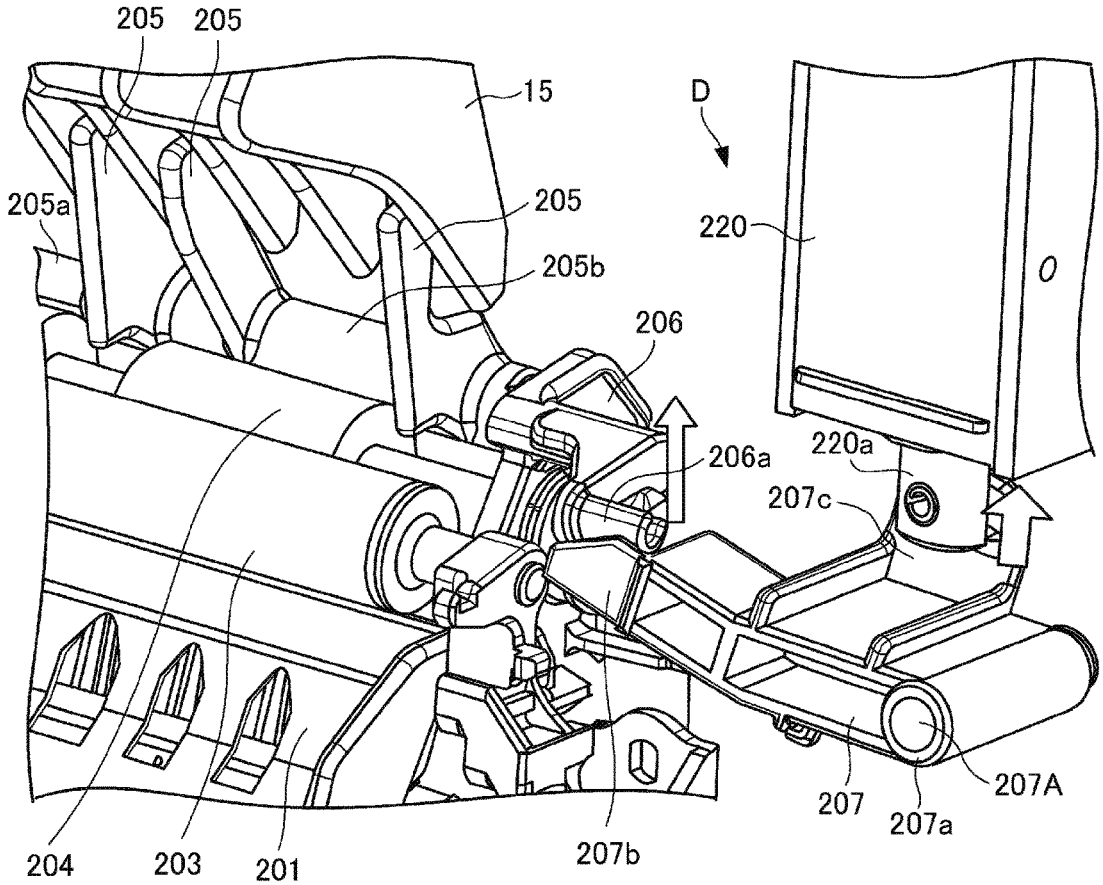
FIG. 6 is a perspective view of part of the fixing device when the guide member positions at a second position, viewed from the side of the sheet feeding path according to the embodiment of the present invention.

The back curl correction structure C, disposed between the branching member 15 and the fixing device 20, includes a drive roller 204, a driven roller 203, a guide member 205, and a guide moving device D (see FIG. 6).

The drive roller 204 and the driven roller 203 are disposed downstream of the separator members 201 and 202. The drive roller 204 is disposed on a side where the recording sheet P generates a back curl in the fixing nip portion, that is, a side of the pressure roller 22 in the sheet feed path between the fixing device 20 and the branching member 15.

The driven roller 203 is disposed on a side where the recording sheet P is heated in the fixing nip portion, that is, at a side of the fixing belt 21 relative to the sheet feed path between the fixing device 20 and the branching member 15.

The drive roller 204 and the driven roller 203 press against each other to form an auxiliary nip portion AN while rotating to assist the recording sheet P to be fed. A distance between the fixing nip portion and the auxiliary nip portion is set to shorter than a length of the recording sheet P.

A structure to prevent a jam from occurring will now be described.

First, a diameter of the drive roller 204 is set greater than that of the driven roller 203. A feeding speed of the recording sheet in the auxiliary nip portion is set slightly smaller than that of the recording sheet in the fixing nip portion. A nip pressure in the auxiliary nip portion is set to slightly smaller than that in the fixing nip portion. With this structure, a jam of the recording sheet P does not occur in the portion between the fixing nip portion and the auxiliary nip portion.

Preferably, at least a circumference of the roller of the drive roller 204 is formed of rubber and at least a circumference of the roller of the driven roller 203 is harder than the circumference of the roller of the drive roller 204, and has a good releasability.

In the present embodiment, the drive roller 204 includes a metal core 204*a* (which corresponds to a roller shaft 204*a*); a solid rubber material 204*b* (which corresponds to a short cylindrical parts 204*b*), having a higher wear coefficient, disposed on the surface of the metal core 204*a*, and obtains performance to feed the recording sheet. Exemplary materials for the solid rubber material 204*b* include silicon, EPDM, urethane, and fluorine rubber.

The driven roller 203 includes a hollow pipe-shaped metal and a tube formed of PFA, ETFA, or FEP with a small depth from 30 μm to 300 μm that covers a surface of the metal pipe.

During fixation, water vapor is generated from the paper and condenses. The hollow pipe-shape metal is used to prevent dew condensation from adhering to the driven roller, because the hollow metal pipe has a low thermal capacity and is heated quickly by the heat from the fixing device.

A tube having a small depth is disposed on the surface of the metal pipe to prevent a small amount of toner that has not melted during the fixation from adhering to the tube, and further, from accumulating thereon even though a certain amount of toner has adhered. Specifically, the driven roller 203 feeds the recording sheet P while constantly contacting the surface on which the image is formed, of the recording sheet P as described heretofore. The driven roller 203 is held to the body of the image forming apparatus by a spring via a holder, and the holder is pressed by the spring, so that the drive roller 204 and the driven roller 203 contact each other to form the auxiliary nip portion AN and auxiliary feed the recording sheet P.

Figure 3:
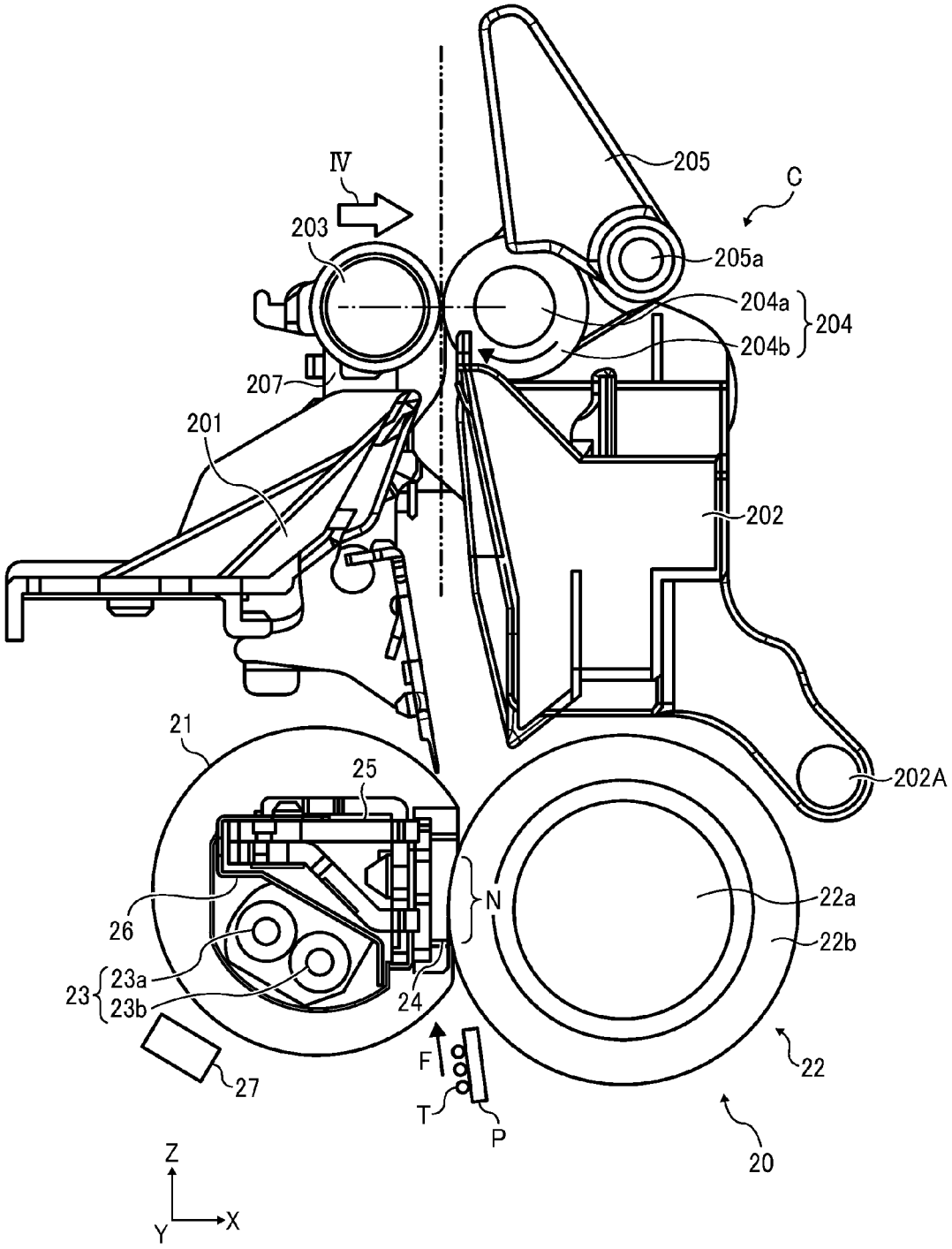
FIG. 3 illustrates the fixing device when a back curl correction is not applied, according to the embodiment of the present invention.

The guide member 205 is so disposed to the fixing device as to coaxially rotate about the roller shaft 204*a* of the drive roller 204. The guide moving device D, which will be described later, drives the guide member 205 based on a control signal from a controller of the apparatus, to move to a first position as illustrated in FIG. 2 or a second position as illustrated in FIG. 3. The first position is a forwarding position to contact the recording sheet P and the second position is a retracted position separating from the recording sheet P.

When positioned at the first position as illustrated in FIG. 2, the guide member 205 slidably contacts a front side of the recording sheet P in the sheet feed direction passing through the auxiliary nip portion in the same side of the drive roller 204, so that the guide member 205 serves to bend the recording sheet P in a concave shape toward a side opposite the back curl of the recording sheet P.

Specifically, the guide member 205 when held at the first position, positions to disturb the path from the same side of the drive roller 204 relative to a direction of the recording sheet P passing through the auxiliary nip portion, which is a right angle to a line connecting each center of the pair of rollers.

Thus, the leading end of the recording sheet P contacts the guide member 205 at a contact angle θ as illustrated in FIG. 2. The recording sheet P is then pressed by the guide member 205 and auxiliary fed by the nip feed force between the drive roller 204 and the driven roller 203.

As a result, the guide member 205 finally feeds the recording sheet P applying a contact angle θ1 with the auxiliary nip portion set as a starting point, so that the recording sheet P bends to form a concave surface at a side opposite the back curl and a back curl correction is thus exerted. By providing such a feeding path, the back curl generated in the fixation of the recording sheet P is ameliorated while passing through the guide member 205, and the recording sheet P is ejected to the sheet ejection tray 14.

However, because the guide member 205 actively contacts a back side of the recording sheet P at the first position, a feed resistance between the back side of the recording sheet P and the guide member 205 is large, thereby applying stress to the sheet itself.

In feeding the second side of the recording sheet P which is not cardboard in the duplex mode, because the first side on which the image is formed and the guide member 205 contact, image rubbing and gloss stripe tend to occur.

In particular, in feeding the second side, the first side image, which is a back side when the fixing unit fixes the second surface image, is again heated while passing through the fixing nip portion. As a result, when the guide member 205 scratches the heated first side image strongly, toner tends to be peeled off and the gloss changes.

Accordingly, the guide member 205 positions at the second position as illustrated in FIG. 3. When positioned at the second position, the guide member 205 does not contact the recording sheet P that is passing through the auxiliary nip portion, so as not to bend the recording sheet P.

The guide member 205 positioned at the second position greatly retracts from the feed direction (that is, a right angle relative to the line connecting each center of the pair of rollers) of the recording sheet P ejected from the auxiliary nip portion, and takes a position not to contact the recording sheet P actively. In this case, the back curl in feeding the sheet is not corrected, but because there is no stress to the sheet, no back side blur, abrasion, image rubbing, and gloss stripe occur.

In feeding the second side of the recording sheet P which is not cardboard in the duplex mode, the back curl does not occur differently from the fixation of the first image side, so that retracting of the guide member 205 to the second position gives a favorable effect.

In feeding the second side of the recording sheet P which is not cardboard in the duplex mode, the guide member 205 does not retract up to the second position, but is configured to reach the first position in at least single-side printing mode among single-side printing mode and duplex printing mode.

On the other hand, when the recording sheet P is cardboard having a high rigidity, such a recording sheet P has a higher contact resistance with the guide member 205 compared to the thin recording sheet P with a low rigidity when the guide member 205 positions at the first position. As a result, the sheet itself receives a greater stress, a contact trace tends to be generated on the back side of the sheet, and the guide member 205 itself tends to be abraded.

However, the back curl does not occur to the recording sheet P being cardboard with a high rigidity. Accordingly, the guide moving device D causes the guide member 205 to move the recording sheet P being cardboard having a high rigidity to the second position as illustrated in FIG. 3 in both cases of feeding the first side in the single-side printing mode and the second side in the duplex printing mode.

As described heretofore, by switching the guide member 205 between the first position and the second position, correction of the back curl and prevention of the image rubbing are achieved collaterally.

Next, the guide member 205 and the guide moving device D will be described in detail referring to FIGS. 4 to 9.

Figure 4:
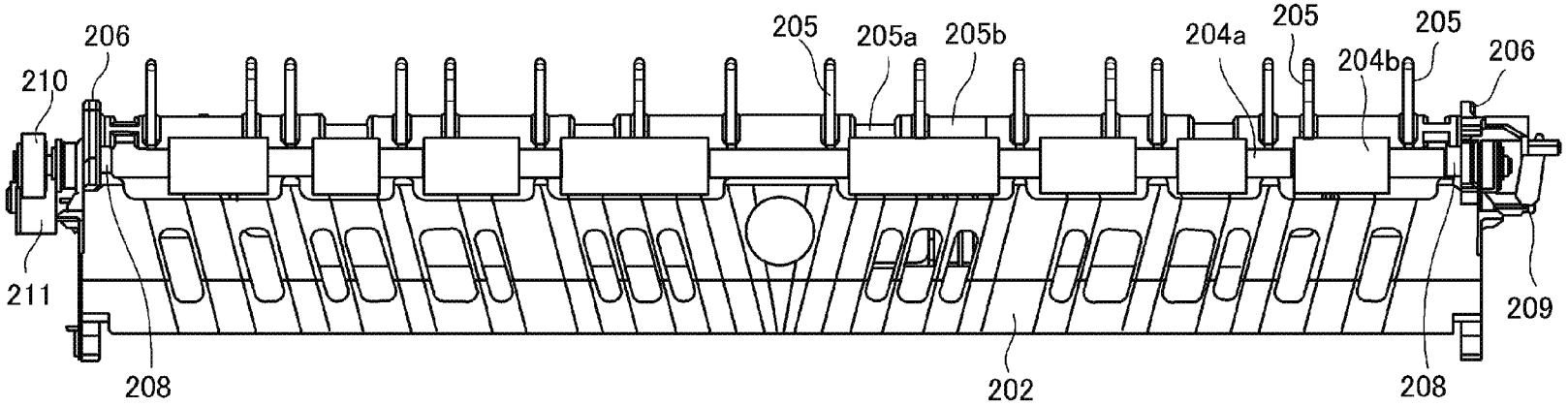
FIG. 4 illustrates a separator member of a pressure roller side and a driver roller viewed from a direction indicated by an arrow IV in FIG. 3.

As illustrated in FIG. 4, the drive roller 204 includes a roller shaft 204*a* and a plurality of short cylindrical parts 204*b*. The both ends of the roller shaft 204*a* are rotatably supported by the pressure-side separator member 202 via sliding bearings 208, and the plurality of short cylindrical parts 204*b* formed of elastic member such as rubber is fixed on the roller shaft 204*a* spaced at predetermined intervals apart.

Rotary drive force from the guide moving device D as illustrated in FIG. 6 is transmitted to a drive gear 210 fixed at an end of the roller shaft 204*a* via an idler gear 211, so that the drive roller 204 rotates.

As illustrated in FIGS. 4 to 7, each of the guide member 205 is fixed to a support shaft 205*a*, both ends of which are rotatably supported at an upper end of a pair of bracket arms 206. The pair of bracket arms 206 rotatably engage on an outer diameter portion of the sliding bearings 208. The guide members 205 are disposed on a plurality of bosses 205*b* secured to engage on the support shaft 205*a*.

An end of the guide member 205 is fixed to each of the bosses 205*b* and another extended end of the guide member 205 extends to cover the drive roller 204. The guide member 205 is configured to stop at a position where a stopper 206*b* of the bracket arm 206 contacts a portion of the pressure-side separator member 202. At this time, the guide member 205 positions at the first position to change the angle of the recording sheet P ejected from the auxiliary nip portion.

Figure 5:
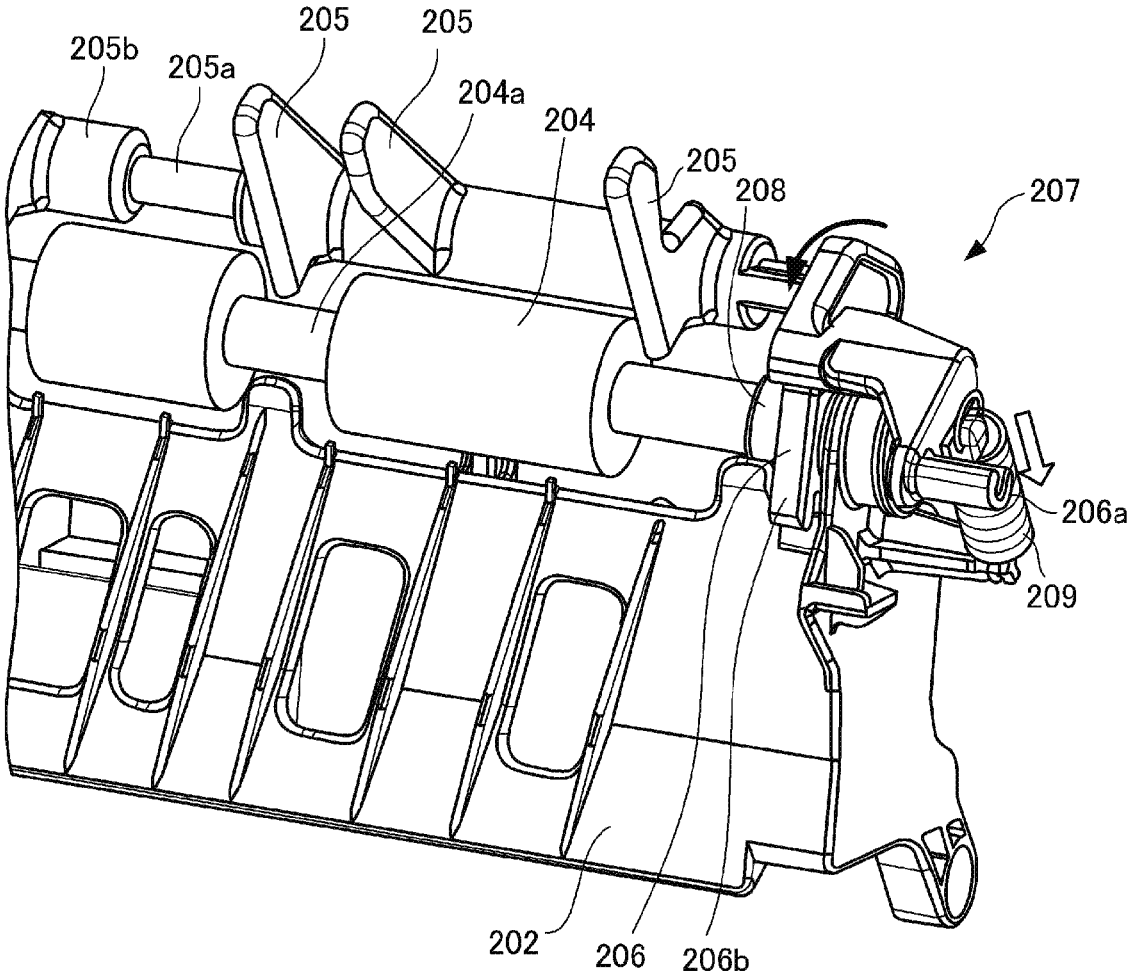
FIG. 5 is a perspective view of part of the fixing device when an exit guide member positions at a first position, viewed from a side of a sheet feeding path according to the embodiment of the present invention.
Figure 7:
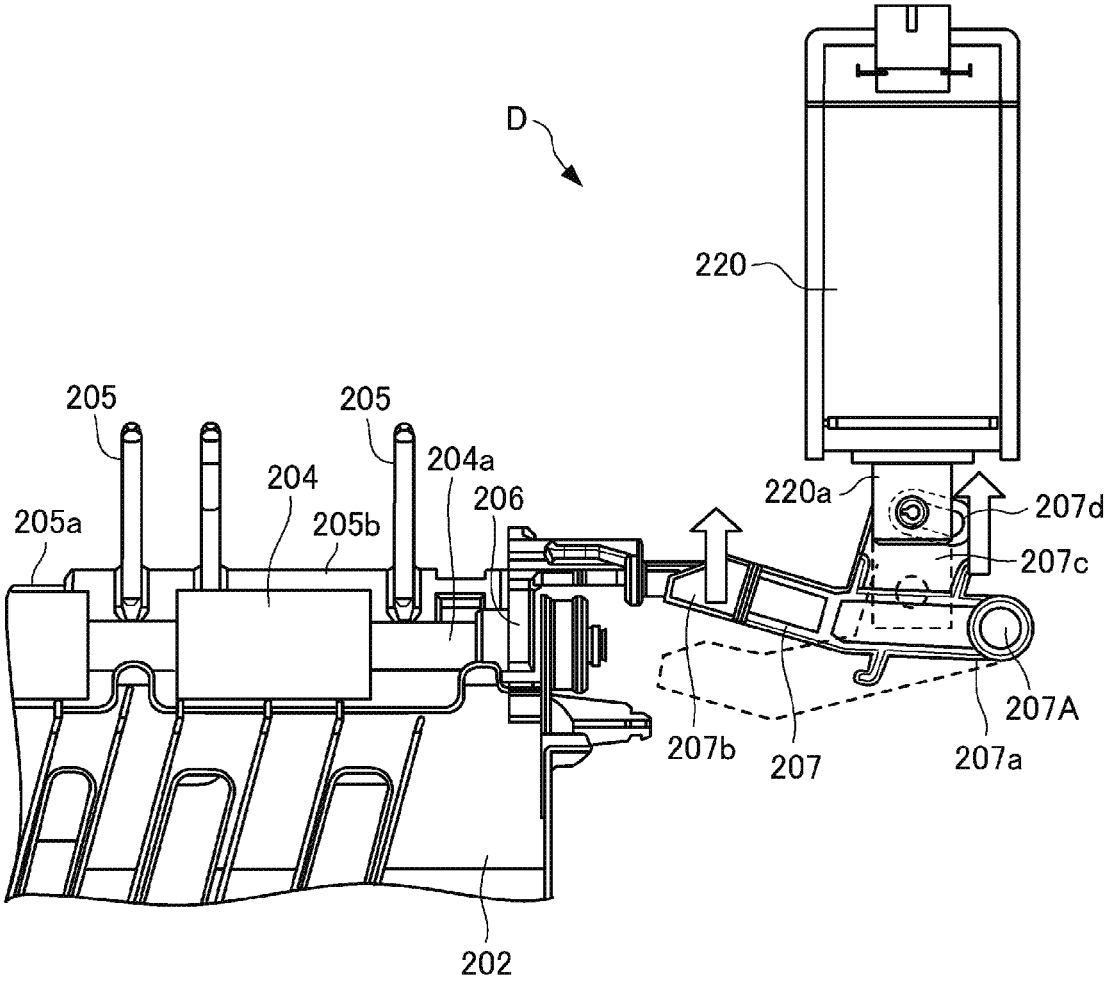
FIG. 7 illustrates part of the fixing device when a guide moving device operates and the guide member positions at the second position, viewed from the sheet feeding path according to the embodiment of the present invention.

As illustrated in FIGS. 5 to 7, the guide moving device D includes a solenoid 220 serving as a drive source, a link structure 207 to oscillate due to operation of the solenoid 220, and an extension spring 209. A body of the solenoid 220 is fixed to the body of the image forming apparatus 1.

One end of the extension spring 209 is engaged with a side surface of the pressure-side separator member 202, and the other end is engaged with an interim part of an arm 206*a* of the bracket arm 206. The extension spring 209 exerts a pulling force to rotate the bracket arm 206 so that the guide member 205 positions at the first position as illustrated in FIG. 2.

As illustrated in FIG. 7, the link structure 207 includes an end 207*a* in the horizontal direction. The end 207*a* is supported by a fixed pin shaft 207A. Another operation end 207*b* contacts to cover, from a bottom side thereof, a leading end of an arm 206*a* of the bracket arm 206. A long slot 207*d* is disposed on an upper end of an upper extension portion 207*c* that extends upward from an interim portion of the link structure 207 in the horizontal direction, and the long slot 207*d* joints an extension rod 220*a* of the solenoid 220 with a pin.

As illustrated in FIG. 7, the extension rod 220*a* of the solenoid 220 extends (the position indicated by a broken line), and as illustrated in FIG. 6, the operation end 207*b* of the link structure 207 is downward separated from the leading end of the arm 206*a* of the bracket arm 206.

Figure 8:
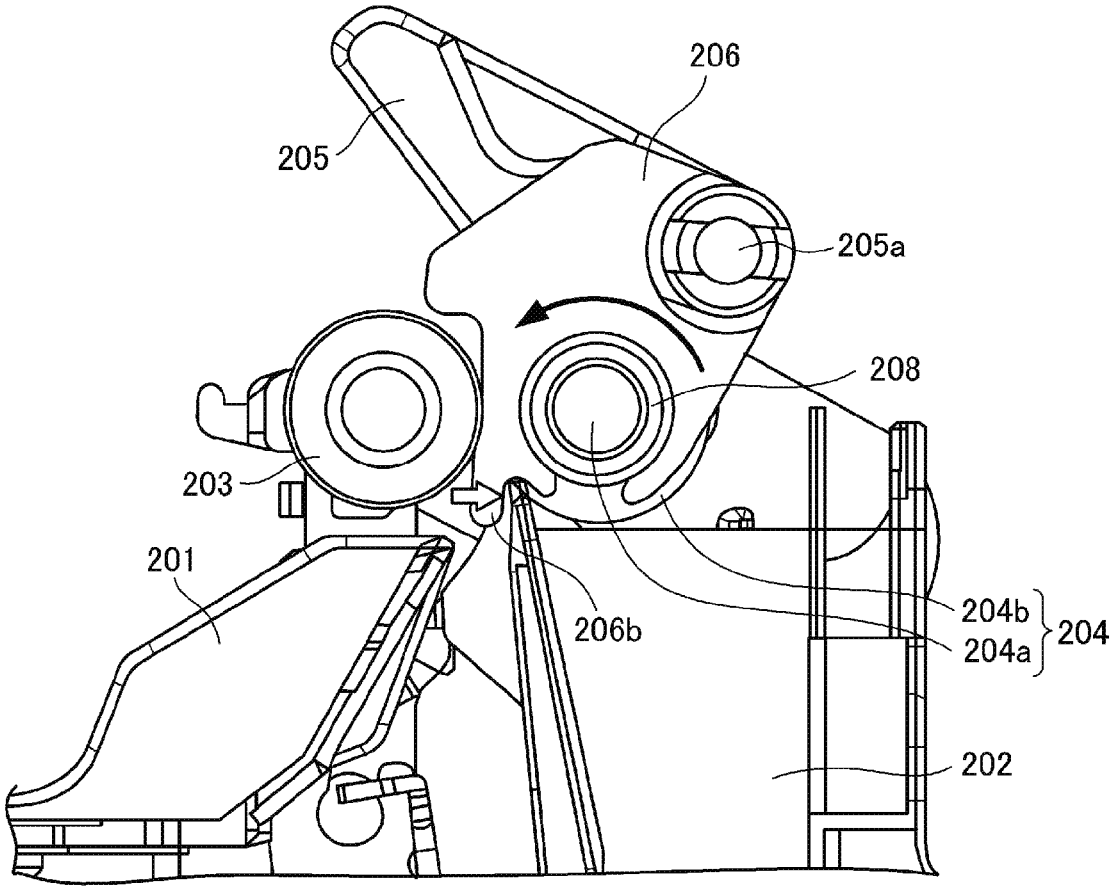
FIG. 8 is a front view of part of the fixing device when the guide member positions at the first position, viewed from the sheet feeding path according to the embodiment of the present invention.
Figure 9:
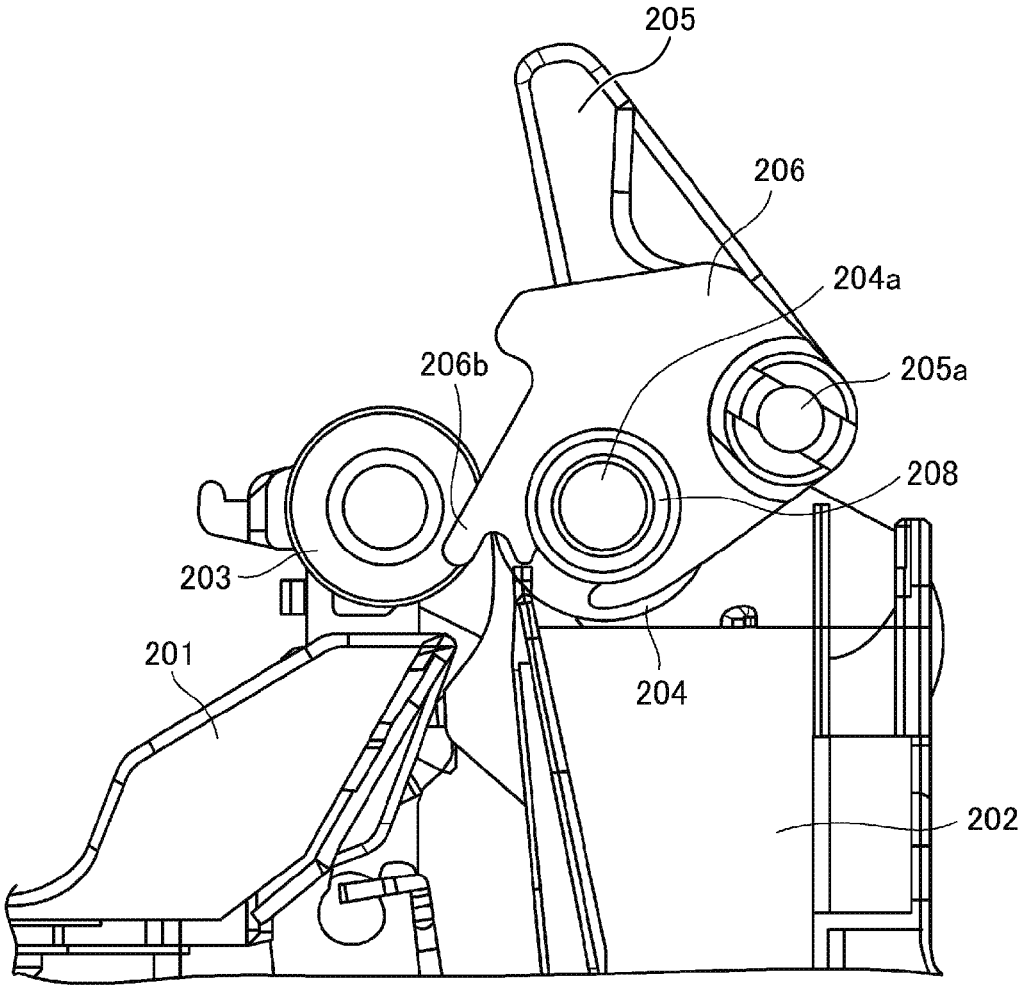
FIG. 9 is a front view of part of the fixing device when the guide member positions at the second position, viewed from the sheet feeding path according to the embodiment of the present invention.

From a state as illustrated in FIG. 6, when electric current is supplied to an internal coil of the solenoid 220 based on control signals of the controller, the extension rod 220*a* of the solenoid 220 retracts. With this, the link structure 207 rotates against the extension force of the extension spring 209, and the operation end 207*b* lifts up the leading end of the arm 206*a* of the bracket arm 206 (as illustrated in FIG. 7). Accordingly, the guide member 205 positions at the second position as illustrated in FIGS. 3 and 9 from the first position as illustrated in FIGS. 2 and 8.

On the other hand, from a state as illustrated in FIG. 7, when the electric current is not supplied to the internal coil of the solenoid 220 based on control signals of the controller, the bracket arm 206 rotates, and the guide member 205 returns to the first position as illustrated in FIG. 2 due to the extension force of the bracket arm 206. With this, due to the extension force of the extension spring 209, the extension rod 220*a* of the solenoid 220 returns to turn into the state as illustrated in FIGS. 5 and 6.

As configured above, a gap between the drive roller 204 and the guide member 205 is minimized such that a cumulative dimensional tolerance of parts is minimized, i.e., with allowances of the radial distance from the shaft center of each part. As a result, the gap between the drive roller 204 and the guide member 205 is kept constant with high precision, and the guide member 205 is movable.

Figure 10:
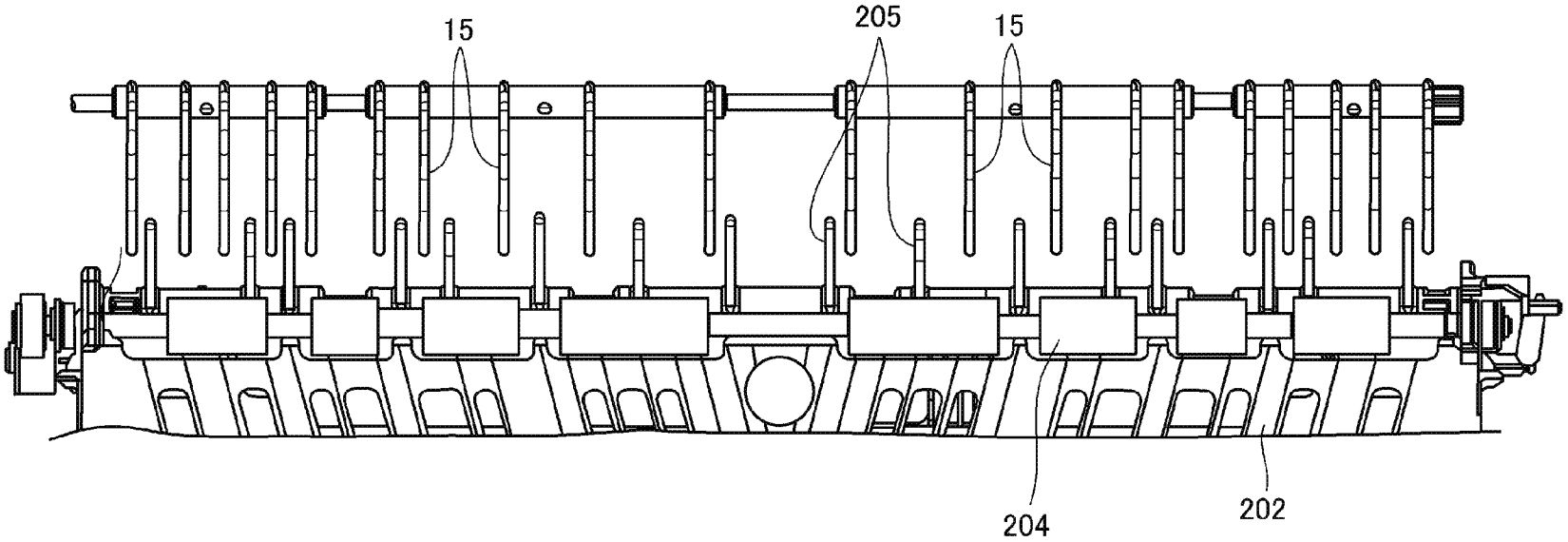
FIG. 10 is a perspective view illustrating a disposition of a branching member and the guide member according to the embodiment of the present invention.

As illustrated in FIG. 10, each branching member 15 is disposed as a plurality of long nails along a width direction perpendicular to the feeding direction of the recording sheet P, and the guide member 205 is also disposed as a plurality of long nails along a width direction perpendicular to the feeding direction of the recording sheet P. Further, the branching member 15 and the guide member 205 are alternatingly disposed in a zig-zag manner.

With this structure, the oscillation area of the branching member 15 and that of the guide member 205 are oscillated independently each other and guide the recording sheet, even though they overlap on the conveyance line of the recording sheet.

FIGS. 11A to 11D represent four feed paths of the recording sheet formed of a combination of the first and second positions of the branching member 15 and the first and second positions of the guide member 205. One-dot chain lines in each of FIGS. 11A to 11D represent feed paths of the recording sheet passing through the auxiliary nip portion formed between the drive roller 204 and the driven roller 203.

Figure 11A:
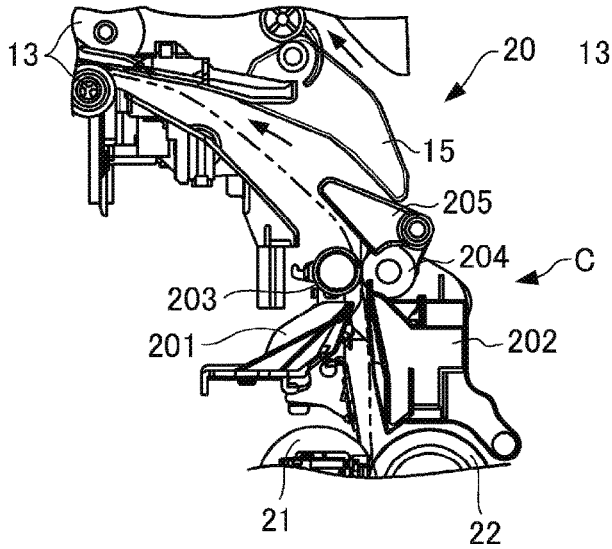
FIGS. 11A to 11D illustrate a plurality of sheet feeding paths, each of which is formed by a combination of a position of the branching member and the guide member according to the embodiment of the present invention.

FIG. 11A illustrates a feed path of the thin recording sheet in single-side printing mode, in which the branching member 15 is disposed at the second position and the guide member 205 is disposed at the first position. The guide member 205 contacts a back of the recording sheet passing through the auxiliary nip portion so as to bend the recording sheet in the concave curved surface in the direction opposite the back curl, to thereby guide the recording sheet to the sheet ejection rollers 13.

Figure 11B:
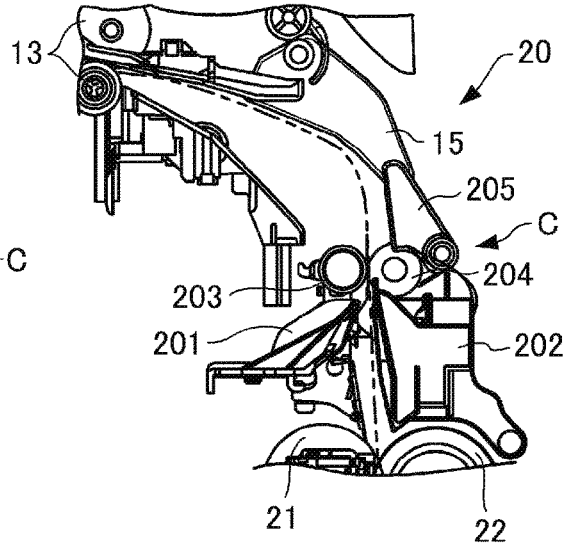

FIG. 11B illustrates a feed path of the thick recording sheet in single-side printing mode, in which the branching member 15 and the guide member 205 both position at the second position. The guide member 205 does not contact a back side of the recording sheet passing through the auxiliary nip portion so as to bend the recording sheet slightly to guide the recording sheet to the sheet ejection rollers 13.

Figure 11C:
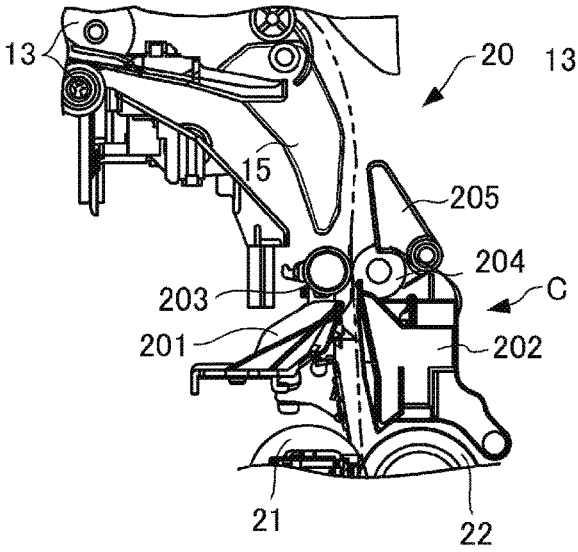

FIG. 11C illustrates a feed path of the thin recording sheet in duplex printing mode, in which the first side of the recording sheet passes, and the branching member 15 is disposed at the first position and the guide member 205 is disposed at the second position. The guide member 205 contacts a back side or the second side of the recording sheet passing through the auxiliary nip portion so as to correct the back curl to a certain degree in the auxiliary nip portion, and the branching member 15 guides the recording sheet to the reverse roller 16.

Figure 11D:
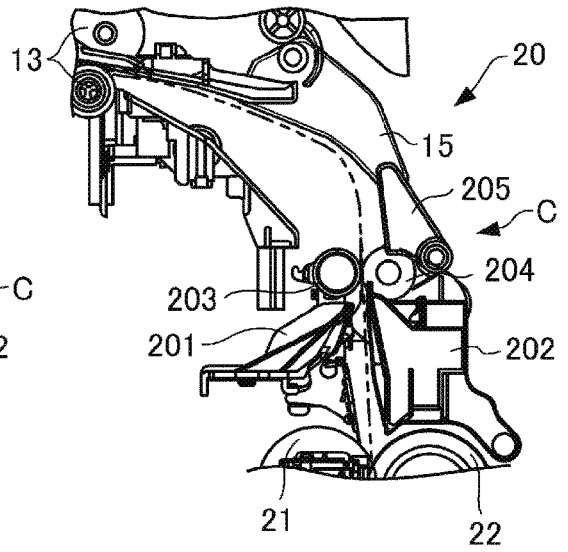

FIG. 11D illustrates a feed path of the thin recording sheet in duplex printing mode, in which the second side of the recording sheet passes, and the branching member 15 and the guide member 205 are both disposed at the second position. The guide member 205 does not contact a back side or a first side of the recording sheet with no back curl while the sheet passing through the auxiliary nip portion, the branching member 15 bends the recording sheet softly to guide the recording sheet to the sheet ejection rollers 13.

As illustrated in FIG. 4, the guide member 205 includes a plurality of ribs along the longitudinal direction and the rib-shaped branching member 15 enters between adjacent guide members 205.

Figure 12:
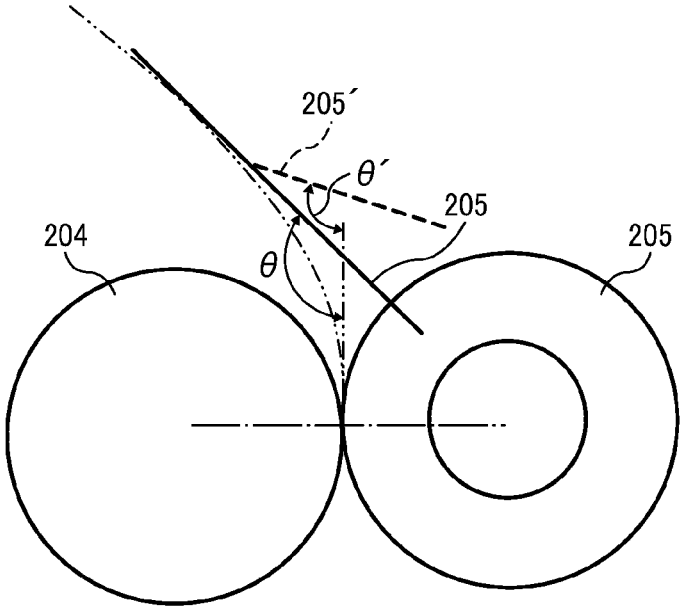
FIG. 12 illustrates an effect of an intersection angle between a recording sheet feeding direction and the guide member in an auxiliary nip portion exerted to the back curl correction, according to the embodiment of the present invention.

FIG. 12 illustrates a case in which the rotary center of the guide member 205 is disposed in accordance with the rotary center of the drive roller 204 (that is, the position in a solid line in the figure), and a comparable case in which the rotary center of the guide member 205 is separated from the rotary center of the drive roller 204 by a certain gap (that is, the position in a dotted line 205' in the figure).

As viewed from FIG. 12, the curl correction effect when the guide member 205 positions at the solid line position and that when the guide member 205 positions at the dotted line position are the same.

Specifically, the recording sheet that passes through the auxiliary nip portion is ejected to a direction perpendicular to the line connecting each rotary center of the drive roller 204 and the driven roller 203. As a result, a contact angle θ' between the leading end of the sheet in the vicinity of the auxiliary nip portion and the guide member 205 when the guide member 205 positions at a dotted-line position is smaller than the contact angle θ between the leading end of the sheet in the vicinity of the auxiliary nip portion and the guide member 205 when the guide member 205 positions at the solid-line position.

If this contact angle decreases, the sheet is fed with its leading end bent and looped, thereby creating a risk of jamming in the worst case. By contrast, when the extension line of the surface of the guide member 205 that positions and contacts the recording sheet is shifted from the rotary center of the drive roller 204 and the contact angle becomes larger than the contact angle θ, the curl correction effect of the guide member 205 to bend the sheet tends to decrease.

Then, in the present embodiment, the rotary center of the guide member 205 is adjusted according to the rotary center of the drive roller 204 to increase the contact angle, and the extension line of the surface of the guide member 205 that contacts the recording sheet, passes through the rotary center of the drive roller 204.

To obtain the curl correction effect, the leading end of the guide member 205 needs to be closer to the auxiliary nip portion, so that the plurality of rubber portions of the drive roller 204 are disposed with a spacing and each guide member 205 enters between the rubber portions.

The image forming apparatus according to the present embodiment, includes the drive roller 204 and the driven roller 203 disposed immediately downstream of the fixing device 20, and the guide member 205 disposed immediately downstream of the auxiliary nip portion. The guide member 205 is switchable between the first position and the second position. With this structure, the fixing device 20 bends the back curl of the recording sheet P to the opposite direction, thereby enabling to correct the back curl only when the correction is necessary.

For example, when the sheet is a thick sheet, no back curl occurs even though pressed in the fixing device 20. As a result, when the guide member 205 positions at the first position constantly, the thick sheet may include a face curl due to the guide member 205. In addition, because the contacting force between the guide member 205 and the recording sheet is strong, the recording sheet suffers a damage such as scratches and the guide member 205 is abraded. Further, due to a high rigidity of the sheet, a leading end of the sheet that contacts the guide member 205 upon going out from the auxiliary nip portion between the drive roller 204 and the driven roller 203, bends, so that the guide member 205 need not be disposed at the first position to correct the back curl.

The image forming apparatus according to the present embodiment includes a guide moving device D to switch the position of the guide member 205 from the above viewpoint, and causes the guide member 205 to be switchably positioned at either the first position or the second position depending on the conditions of the recording sheet P. The present invention provides an image forming apparatus capable of reducing a back curl due to fixation, stabilizing sheet conveyance, and reducing damage to the recording sheet P and toner image.

Because the rotary center of the guide member 205 is configured coaxially with the shaft center of the drive roller 204 in the image forming apparatus according to the present embodiment, precision in the angle of the guide member 205 to correct the curl is achieved with a high precision without variations using a minimum number of parts.

The image forming apparatus according to the present embodiment includes the guide member 205 disposed at the first position during single-side printing operation, so that the recording sheet P having a back curl due to fixation in the fixing device can be ejected with the back curl corrected. The back curl correction enables to stack a predetermined number of sheets on the sheet ejection tray 14 and prevents the stacked sheets from being messy. Further, in the duplex printing, the guide member 205 positions at the second position, thereby preventing image rubbing and gloss flaws on the first side.

Because the back curl when the image on the first side is fixed, is corrected when the image on the second side is fixed, the back curl is reduced in number when the recording sheet is ejected, and there is no need of correcting the curl when the guide member 205 is positioned at the first position. By contrast, the guide member 205 and the first side of the recording sheet strongly contact each other at the first position, to thus cause image rubbing and gloss stripes, and so, the guide member 205 needs to be positioned at the second position.

The image forming apparatus according to the present embodiment is configured such that the guide member 205 is retracted to the second position when printing the second side of the thin recording sheet in the duplex printing mode, and printing a thick sheet. Thus, the problem occurring when the guide member 205 is secured to the first position can be obviated.

The image forming apparatus according to the present embodiment is configured such that the back curl does not occur in the fixing device 20 when printing the second side of the thin recording sheet in the duplex printing mode, and printing a thick sheet. Thus, the problem of face curl occurring when the guide member 205 is fixed to the first position, can be obviated. In addition, the problem of flaws on the back side of the sheet and abrasion of the guide member 205 can be obviated. Further, the problem that the leading end of the sheet that contacts the guide member 205, upon going out from the auxiliary nip portion, does not bend but folds due to the high rigidity of the sheet, can be obviated.

The image forming apparatus according to the present embodiment employs a solenoid 220 as a driving unit for the guide moving device D, which easily connects to the link structure 207 and space saving is exerted at a low cost. By contrast, when using a motor such as a stepping motor, which costs high and increases an entire size as a driving unit including gear rows for drive transmission, a large space is needed and the entire image forming apparatus becomes large.

Preferably, a circumference of the roller of the drive roller 204 is formed of rubber and that a circumference of the roller of the driven roller 203 is harder than the circumference of the roller of the drive roller 204 and has a releasability. As a result, when the guide member 205 positions at the first position (when a curl correction is performed), the recording sheet ejected from the auxiliary nip portion between the drive roller 204 and the driven roller 203 contacts the guide member 205 and the angular direction of the recording sheet is drastically changed. Thus, even with a high feed resistance, a higher feed power exceeding the feed resistance is obtained, and even though a small amount of toner not melted during the fixation adheres to the driven roller 203 facing the image side of the sheet, but does not accumulate thereon. With this structure, the toner image after fixation is prevented from peeling off when being fed in the auxiliary nip portion, and from occurring of flaws.

In the embodiment of the present invention, the first position of the guide member 205 depending on the strictly defined relative positions of the guide member 205 and the driven roller 203 is configured to be complete inside the unit, and the second position thereof is configured to be defined by the driving unit of the side of the apparatus body, but the both positions may be defined in the manner opposite to the above. In addition, the guide member 205 may employ a stepping motor as a driving unit, so that a posture and position of the guide member 205 may be defined in plural levels.

In the above first embodiment, the first position is a position in which the guide member 205 contacts the back side of the recording sheet P actively, so that the feed resistance between the back side of the recording sheet P and the guide member 205 is large, which gives a stress to the sheet itself.

Then, to reduce the feed resistance between the back side of the recording sheet P and the guide member 205 and the stress given to the sheet itself, printing tests were performed to find an appropriate position for the first position of the guide member 205. The printing test was performed using a prototype fixing device according to the present embodiment, in which an end edge of the guide member 205 is directly formed and values of a first intersection angle or an initial contact angle θ, a second intersection angle or a sheet bending angle θ1, and a distance L were changed variously. The printing test is to evaluate whether an effect of curl correction can be obtained and whether a condition to disturb the feeding property occurs or not, and results shown in Table 1 were obtained.

TABLE 1

| | Evaluation condition | | | Results | | |
|---|---|---|---|---|---|---|
| | Θ1 | L | θ | Curl correction | Feeding property | Overall evaluation |
| Comparable Example 1 | 55° | 20 mm | 100° | NG | NG | NG |
| Comparable Example 2 | 55° | 15 mm | 100° | Good | NG | NG |
| Comparable Example 3 | 50° | 15 mm | 110° | Good | NG | NG |
| Example 1 | 40° | 15 mm | 120° | Good | Good | Good |
| Example 2 | 25° | 10 mm | 143° | Good | Good | Good |
| Comparable Example 4 | 15° | 5 mm | 162° | NG | Good | NG |
| Example 3 | 20° | 5 mm | 157° | Good | Good | Good |
| Example 4 | 25° | 5 mm | 150° | Excellent | Good | Good |
| Example 5 | 40° | 5 mm | 133° | Excellent | Good | Good |
| Example 6 | 50° | 5 mm | 126° | Excellent | Good | Good |
| Comparable Example 5 | 50° | 5 mm | 118° | Excellent | NG | NG |

Remarks:
Collateral conditions: From 20° to 50°; 15 mm or less; and 120° or greater The initial contact angle θ in FIG. 13 corresponds to the intersection angle between the recording sheet feeding direction in the auxiliary nip portion and the guide direction of the guide member 205. The sheet bending angle θ1 in FIG. 13 corresponds to an intersection angle between the recording sheet feeding direction in the auxiliary nip portion and a direction connecting a point from which the recording sheet separates from the auxiliary nip portion to downstream and a point at which the guide member 205 contacts the recording sheet. The distance L in FIG. 13 corresponds to a distance from the center position of the auxiliary nip portion to the guide member 205 in the recording sheet feeding direction in the auxiliary nip portion.

Figure 14:
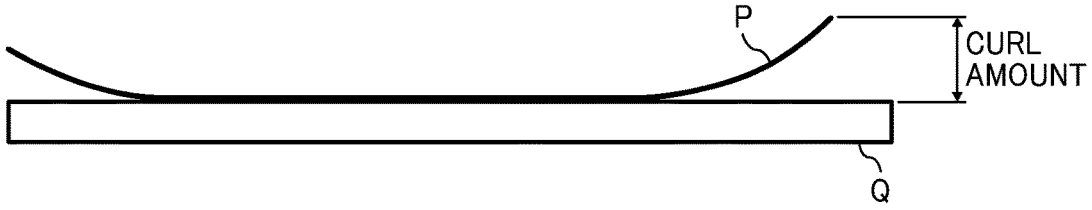
FIG. 14 illustrates a method to measure a curl amount to evaluate an effect of curl correction according to the embodiment of the present invention.

Table 1 shows a three-grade evaluation of Excellent, Good, and NG. With the prototype fixing device according to the present embodiment, first, printing is performed without performing the curl correction by the guide member 205. FIG. 14 illustrates a curl amount of a test sheet P ejected after an image has been fixed thereon. The test sheet P is placed on a plane table Q and a distance between the end edge of the test sheet P and the surface of the plane table Q is obtained. Next, the test sheet P to which the curl correction by the guide member 205 is applied is placed on the plane table Q and the curl amount in this case is measured.

Then, compared to the curl amount without the curl correction by the guide member 205, when the curl amount of the test sheet P to which the curl correction by the guide member 205 is applied, reduces more than 10 mm, it is evaluated as Excellent. When the reduced curl amount is from 5 mm to less than 10 mm, it is evaluated as Good, and the reduced curl amount of less than 5 mm is evaluated as No Good (NG). As test results, comparative examples 1 and 4 are ranked NG concerning the curl correction.

Table 1 also shows a two-grade evaluation of Good and NG concerning the feeding property. The feeding property was evaluated with the prototype fixing device according to the present embodiment as to 11 examples including comparative examples 1 to 5 and examples 1 to 6 related to thin sheets of the basis weight of 52 g/m$^2$. The evaluation of the feeding property was evaluated by setting the values of θ, θ1, and L in FIG. 13 with values in Table 1 and printing of 1,000 sheets were performed for each value set. If even one sheet is fed with a leading end folded or a paper jam occurs, it is evaluated as NG. If no such event occurs, it is evaluated as Good. As test results, comparative examples 1 to 3 and 5 are ranked NG concerning the feeding property.

As to the overall evaluation in Table 1, when the both test results concerning the curl correction and the feeding property are NG, the overall evaluation is ranked NG. According to the results in Table 1, the range of values evaluated Good in the overall evaluation was identified. As a result, when the first position of the guide member 205 is set as follows, the reduction of the back curl occurring in the fixation and the stable feeding were collaterally achieved. The intersection angle θ1 is from 20 degrees to less than 50 degrees, the distance L is 15 mm or less, and the intersection angle θ is 120 degrees or greater.

Figure 13:
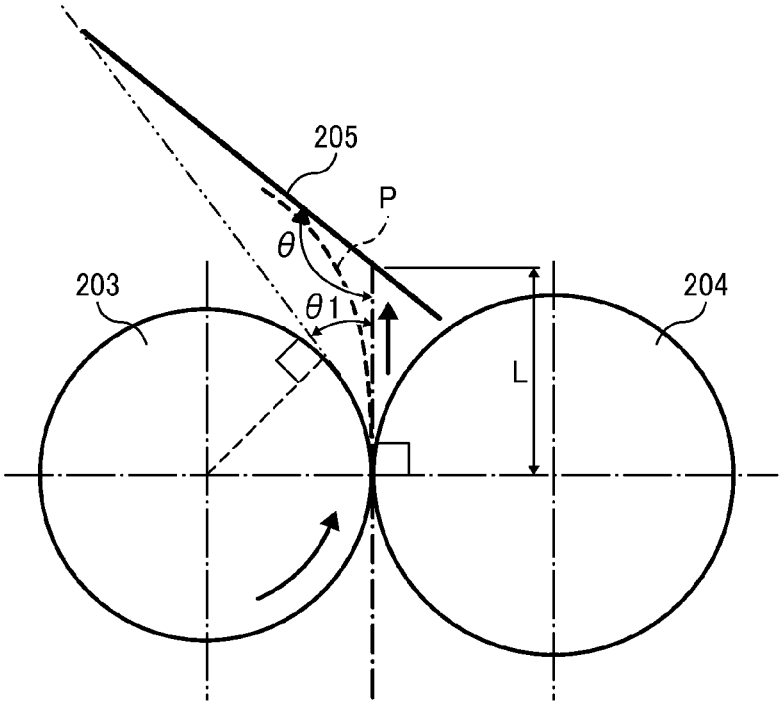
FIG. 13 illustrates a measuring condition to measure an effect of curl correction and feeding property by the guide member when the guide member is straightly formed according to the embodiment of the present invention.
Figure 15:
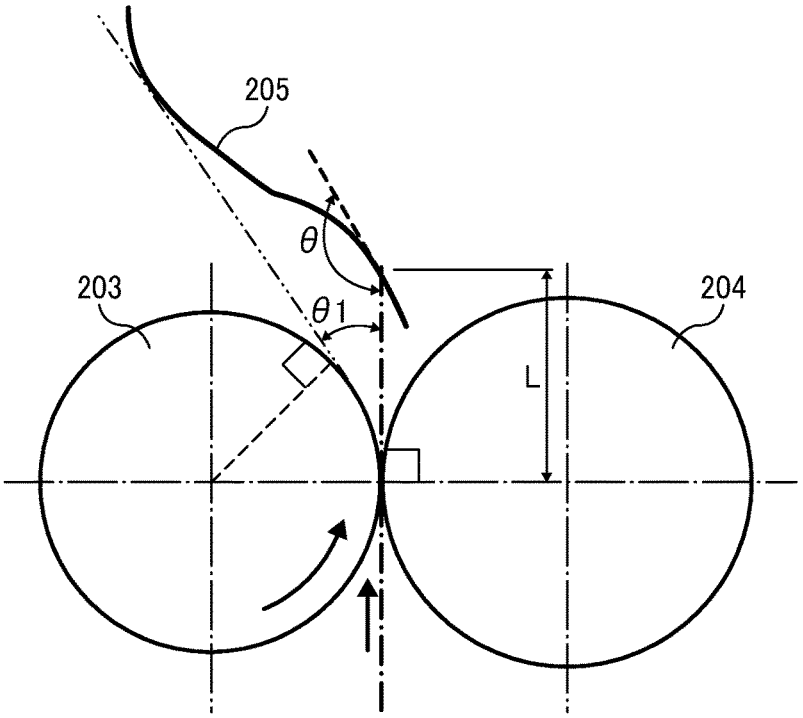
FIG. 15 illustrates a measuring condition to measure an effect of curl correction and feeding property by the guide member when the guide member is curved according to the embodiment of the present invention.

As illustrated in FIG. 15, even when the end edge of the guide member 205 is curved, when the values of the first intersection angle θ, the second intersection angle θ2, and the distance L in FIG. 15 are the same as those of the first intersection angle θ, the second intersection angle θ1, and the distance L in FIG. 13, the same results in Table are obtained.

On the other hand, in feeding the second side of the recording sheet P which is not a cardboard in the duplex mode, because the first side on which the image is formed and the guide member 205 contacts, image rubbing and gloss stripe tend to occur.

In particular, in feeding the second side, the first side image, which is a back side when the fixing device fixes the second surface image, is again heated while passing through the fixing nip portion. As a result, when the guide member 205 scratches the heated first side image strongly, toner tends to be peeled off and the gloss changes.

Accordingly, the guide member 205 positions at the second position as illustrated in FIG. 3. When positioned at the second position, the guide member 205 does not contact the recording sheet P that is passing through the auxiliary nip portion, so as not to bend the recording sheet P.

The guide member 205 positioned at the second position greatly retracts from the feed direction (that is, a right angle relative to the line connecting each center of the pair of rollers) of the recording sheet P ejected from the auxiliary nip portion, and takes a position not to contact the recording sheet P actively. In this case, the back curl in feeding the sheet is not corrected, but because there is no stress to the sheet, no back side blur, abrasion, image rubbing, and gloss stripe occur.

In feeding the second side of the recording sheet P which is not a cardboard in the duplex mode, the back curl does not occur differently from the fixation of the first image side, so that retracting of the guide member 205 to the second position gives a favorable effect.

In feeding the second side of the recording sheet P which is not a cardboard in the duplex mode, the guide member 205 does not retract up to the second position, but is configured to reach the first position in at least single-side mode printing among single-side printing mode and duplex printing mode.

On the other hand, when the recording sheet P is a cardboard having a high rigidity, such a recording sheet P has a higher contact resistance with the guide member 205 compared to the thin recording sheet P with a low rigidity when the guide member 205 positions at the first position. As a result, the sheet itself receives a greater stress, a contact trace tends to occur on the back side of the sheet, and the guide member 205 itself tends to be abraded.

However, the back curl does not occur to the recording sheet P being a cardboard with a high rigidity. Accordingly, when the recording sheet P is a cardboard having a high rigidity, the guide member 205 is positioned at the second position as illustrated in FIG. 3 in both cases of feeding the first side in the single-side printing mode and the second side in the duplex printing mode.

As described above, by switching the guide member 205 between the first position and the second position, correction of the back curl and prevention of the image rubbing are achieved collaterally.

The image forming apparatus according to the present embodiment, includes the drive roller 204 and the driven roller 203 disposed immediately downstream of the fixing device 20, and the guide member 205 disposed immediately downstream of the auxiliary nip portion. The guide member 205 is switchable between the first position and the second position. With this structure, the fixing device 20 bends the back curl of the recording sheet P to the opposite direction, thereby enabling to correct the back curl only when the correction is necessary.

For example, when the sheet is a thick sheet, no back curl occurs even though pressed in the fixing device 20. As a result, when the guide member 205 positions at the first position, the thick sheet may include a face curl due to the guide member 205 By contrast. In addition, because the contacting force between the guide member 205 and the recording sheet is strong, the recording sheet suffers a damage such as scratches and the guide member 205 is abraded. Further, due to a high rigidity of the sheet, a leading end of the sheet that contacts the guide member 205 upon going out from the auxiliary nip portion between the drive roller 204 and the driven roller 203, bends, so that the guide member 205 need not be disposed at the first position to correct the back curl.

The image forming apparatus according to the present embodiment includes a guide moving device to switch the position of the guide member 205 from the above viewpoint, and causes the guide member 205 to be switchably positioned at either the first position or the second position depending on the conditions of the recording sheet P. Thus, the image forming apparatus achieves the reduction of the back curl due to fixation, and stable feeding of the sheet, and reduces damage to the recording sheet P.

The image forming apparatus according to the present invention is configured such that the feeding speed of the recording sheet in the downstream auxiliary nip portion is set to slightly faster than that of the recording sheet in the fixing nip portion. With this structure, slack of the sheet between the auxiliary feed roller and the guide member lessens, effect of bending the recording sheet is obtained.

In order to perform curl correction using the roller pair and the guide member that can correct the back curl, adjustment of the angle between the roller pair and the guide member with a high precision is important. Specifically, a relation between the angle of the recording sheet ejected from the roller pair and the angle of the guide member is important. Further, to securely feed the leading end of the curled sheet due to fixation, a relative positions of the roller pair and the leading end of the guide member can be rigidly set.

The rotary center of the guide member 205 is configured coaxially with the shaft center of the drive roller 204 in the image forming apparatus according to the present embodiment. With this structure, precision in the angle of the guide member 205 to correct the curl is formed with a high precision without variations using a minimum number of parts, and the positions of the roller pair and the guide member can be maintained with a high precision.

The image forming apparatus according to the present embodiment includes the guide member 205 disposed at the first position during single-side printing operation, so that the recording sheet P having a back curl due to fixation in the fixing device can be ejected with the back curl corrected. The back curl correction enables to stack a predetermined number of sheets on the sheet ejection tray 14 and prevents the stacked sheets from being messy. Further, in the duplex printing, the guide member 205 positions at the second position, thereby preventing image rubbing and gloss flaws on the first side.

The image forming apparatus according to the present embodiment is configured such that the back curl does not occur in the fixing device 20 when printing the second side of the thin recording sheet in the duplex printing mode, and printing a thick sheet. Thus, the problem of face curl occurring when the guide member 205 positions at the first position, can be obviated. In addition, the problem of flaws on the back side of the sheet and abrasion of the guide member 205 can be obviated. Further, the problem that the leading end of the sheet that contacts the guide member 205, upon going out from the auxiliary nip portion, does not bend but folds due to the high rigidity of the sheet, can be obviated.

As described heretofore, the image forming apparatus according to the present invention achieves reduction of back curl due to fixation and stabilized feeding of sheets, and reduces damage to the recording sheet and toner image.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image forming device configured to transfer a first image to a recording sheet;

a fixing device configured to feed the recording sheet to a fixing nip portion and fix the first image onto the recording sheet;

a branching device configured to switch between an ejection path to eject the recording sheet fed downstream of the fixing device, to outside the apparatus, and a reversing path for duplex printing; and a back curl correction structure in a sheet feeding path between the fixing device and the branching device, the back curl correction structure including:

a drive roller at a side where a back curl is generated on the recording sheet in the fixing nip portion;

a driven roller at a side where the recording sheet is heated;

an auxiliary nip portion between the drive roller and the driven roller, configured to press and feed the recording sheet auxiliarily;

a guide member, at a same side as the drive roller relative to the sheet feeding path, configured to guide the recording sheet; and a guide moving device configured to move the guide member to a first position to press the recording sheet while the recording sheet is passing through the auxiliary nip portion and a second position separated from the recording sheet.

2. The image forming apparatus according to claim 1, wherein the first position of the guide member is defined by:

a sheet bending angle θ1 corresponding to an intersection angle between a recording sheet feeding direction in the auxiliary nip portion and a direction connecting a point from which the recording sheet separates downstream from the auxiliary nip portion and a point at which the guide member contacts the recording sheet, being from 20 degrees to less than 50 degrees;

a distance L from a center position of the auxiliary nip portion to the guide member in the recording sheet feeding direction in the auxiliary nip portion being 15 mm or smaller; and an initial contact angle θ corresponding to an intersection angle between the recording sheet feeding direction in the auxiliary nip portion and a guide direction of the guide member being 120 degrees or greater.

3. The image forming apparatus according to claim 2, wherein a feeding speed of the recording sheet in the auxiliary nip portion is set to slightly faster than a feeding speed of the recording sheet in the fixing nip portion.

4. The image forming apparatus according to claim 2, wherein a rotary center of the guide member is coaxial with a roller shaft of the drive roller, and wherein the guide moving device is configured to cause the guide member to rotate to move to a plurality of positions.

5. The image forming apparatus according to claim 1, wherein a rotary center of the guide member is coaxial with a roller shaft of the drive roller, and wherein the guide moving device is configured to switch the guide member between the first position and the second position.

6. The image forming apparatus according to claim 1, wherein the image forming apparatus has a single-side printing mode and a duplex printing mode, and wherein the guide member is configured to reach the first position in at least the single-side printing mode among the single-side printing mode and the duplex printing mode.

7. The image forming apparatus according to claim 1, wherein the guide moving device is configured to move the guide member to the second position when the recording sheet is cardboard.

8. The image forming apparatus according to claim 1, wherein the guide moving device includes:

a solenoid as a drive source; and a linking device configured to move the guide member to either the first position or the second position via the solenoid.

9. The image forming apparatus according to claim 1, wherein a first circumferential surface of the drive roller is formed of elastic material, and wherein a second circumferential surface of the driven roller is harder and has a higher releasability than the first circumferential surface of the drive roller.

10. The image forming apparatus according to claim 1, wherein the branching device is configured to switch to the ejection path and the guide member is oriented in the first position, when the recording sheet is relatively thin and the apparatus is in a single-side printing mode.

11. The image forming apparatus according to claim 1, wherein the branching device is configured to switch to the ejection path and the guide moving device is configured to move the guide member to the second position, when the recording sheet is relatively thick.

12. The image forming apparatus according to claim 1, wherein the branching device is configured to switch to the reversing path and the guide moving device is configured to move the guide member to the second position, when the apparatus is in a duplex printing mode, the first image has been fixed on a first side of the recording sheet, and a second image has not been fixed on a second side of the recording sheet.

13. The image forming apparatus according to claim 1, wherein the branching device is configured to switch to the ejection path and the guide member is oriented in the second position, when the apparatus is in a duplex printing mode, the first image has been fixed on a first side the recording sheet, and a second image has been fixed on a second side of the recording sheet.

14. The image forming apparatus according to claim 12, wherein the branching device is configured to switch to the ejection path and the guide member is oriented in the second position, when the apparatus is in a duplex printing mode, the first image has been fixed on the first side of the recording sheet, and the second image has been fixed on the second side of the recording sheet.

15. The image forming apparatus according to claim 14, wherein the branching device is configured to switch to the ejection path and the guide member is oriented in the first position, when the recording sheet is relatively thin and the apparatus is in a single-side printing mode; and wherein the branching device is configured to switch to the ejection path and the guide moving device is configured to move the guide member to the second position, when the recording sheet is relatively thick.

* * * * *